US009232308B2

(12) United States Patent
Murata et al.

(10) Patent No.: US 9,232,308 B2
(45) Date of Patent: Jan. 5, 2016

(54) HEADPHONE DEVICE, WEARING STATE DETECTION DEVICE, AND WEARING STATE DETECTION METHOD

(71) Applicant: Sony Corporation, Minato-ku (JP)

(72) Inventors: Yasunobu Murata, Tokyo (JP); Kohei Asada, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 233 days.

(21) Appl. No.: 13/923,787

(22) Filed: Jun. 21, 2013

(65) Prior Publication Data

US 2014/0037101 A1 Feb. 6, 2014

(30) Foreign Application Priority Data

Aug. 2, 2012 (JP) ..... 2012-171975

(51) Int. Cl.
*H04R 1/10* (2006.01)
*H04R 3/00* (2006.01)

(52) U.S. Cl.
CPC ..... *H04R 3/00* (2013.01); *H04R 1/1041* (2013.01); *H04R 3/005* (2013.01); *H04R 2420/07* (2013.01); *H04R 2460/03* (2013.01)

(58) Field of Classification Search
CPC ..... H04R 5/033; H04R 1/105; H04R 1/1083; G10K 2210/1081
USPC ..... 381/72, 74, 71.6, 376, 381, 370
See application file for complete search history.

(56) References Cited

U.S. PATENT DOCUMENTS 6,704,428 B1 * 3/2004 Wurtz ..... G10K 11/1788 381/370
2004/0042629 A1 * 3/2004 Mellone ..... H04R 1/1058 381/310
2006/0029234 A1 * 2/2006 Sargaison ..... 381/74
2009/0154720 A1 * 6/2009 Oki ..... 381/74

FOREIGN PATENT DOCUMENTS

JP SHO 56-193966 U 7/1983
JP HEI 07-240989 A 9/1995

(Continued)

OTHER PUBLICATIONS

Office Action issued on Jul. 21, 2015 in Japanese Patent Application No. 2012-171975, along with its English translation.

*Primary Examiner* — Disler Paul
(74) *Attorney, Agent, or Firm* — Oblon, McClelland, Maier & Neustadt, L.L.P.

(57) ABSTRACT

Provided is a headphone device including an outside microphone attached to a position at which an extraneous sound is picked up without passing through a shield in a state in which a user is wearing the headphone device, an inside microphone attached to a position at which the extraneous sound is picked up via the shield in the state in which the user is wearing the headphone device, a driver unit which performs an acoustic output, and a wearing state detection unit which detects a wearing or non-wearing state using a signal comparison result between sound signals obtained by the outside and inside microphones, respectively, a pre-stored non-wearing state reference value which is a signal comparison result when the extraneous sound arrives in the non-wearing state, and a pre-stored wearing state reference value which is a signal comparison result when the extraneous sound arrives in the wearing state.

17 Claims, 25 Drawing Sheets

(56) References Cited

FOREIGN PATENT DOCUMENTS

| | | |
|---|---|---|
| JP | 2002-281583 | 9/2002 |
| JP | 2008-289033 | 11/2008 |
| JP | 2009-207053 | 9/2009 |
| JP | 2009-232423 | 10/2009 |

* cited by examiner

FB TYPE NOISE CANCELING SYSTEM

FB TYPE NC AND DETECTION MECHANISM

FB TYPE NC AND DETECTION MECHANISM (REPRODUCTION SOUND INPUT PRESENCE)

REFERENCE CHARACTERISTICS BY PRE-MEASUREMENT
LEFT) NON-WEARING RIGHT) WEARING

COMPARISON BETWEEN REFERENCE CHARACTERISTICS AND ACTUAL OPERATION CHARACTERISTICS
LEFT) ASSUMPTION OF NON-WEARING RIGHT) ASSUMPTION OF WEARING

WEARING STATE DETECTION

FF TYPE NOISE CANCELING SYSTEM

FF TYPE NC AND DETECTION MECHANISM

FF TYPE NC AND DETECTION MECHANISM (REPRODUCTION SOUND SIGNAL PRESENCE)

FF AND FB TYPE NOISE CANCELING SYSTEM

FF AND FB TYPE NC AND DETECTION MECHANISM

FF AND FB TYPE NC AND DETECTION MECHANISM (REPRODUCTION SOUND SIGNAL PRESENCE)

WHEN THERE IS NO REPRODUCTION SOUND SIGNAL

HEADPHONE DEVICE, WEARING STATE DETECTION DEVICE, AND WEARING STATE DETECTION METHOD

BACKGROUND

The present disclosure relates to a headphone device, a wearing state detection device, which detects whether a user wears the headphone device, and a wearing state detection method.

Like headphones equipped with a so-called noise canceling system, wireless headphones corresponding to Bluetooth (registered trademark), or the like, there are headphones (active headphones) internally including an active circuit and equipped with a battery.

After the active headphones are used, a user often forgets to turn off a power supply. If the user forgets to turn off the power supply upon taking off the headphones, the battery is consumed, and is often drained when the headphones are used the next time.

There is also a product using a dedicated built-in rechargeable battery in the active headphones. When the user has forgotten to turn off the power supply and the battery is drained, in a product incapable of switching to "passive", the user is inconvenienced and has to forgo use of the product or use an external battery box.

In addition, although there are products capable of switching to "passive", listening while maximizing performance of the product is difficult even in this case.

SUMMARY

It is desirable to automatically detect wearing/non-wearing and perform appropriate operation control according to the detected wearing/non-wearing in active headphones.

There are several technologies related to detection of wearing of headphones.

For example, as in Japanese Unexamined Patent Application Publication No. 2008-289033, wearing is detected using a temperature sensor. As in Japanese Unexamined Patent Application Publication No. 2002-281583, a special mechanism (a hook or the like) is provided and a power supply is controlled by opening/closing the hook according to wearing/non-wearing.

Incidentally, in the technology of Japanese Unexamined Patent Application Publication No. 2008-289033, a part to which the sensor is attached is determined by usage of a user. In addition, the technology of Japanese Unexamined Patent Application Publication No. 2002-281583 affects a design. In addition, the restriction of an increase in size also occurs in the case of inner ear headphones to be worn in the ears.

In addition, although a method using a spectrum of a sound signal to be reproduced has been proposed as in Japanese Unexamined Patent Application Publication No. 2009-207053, there may be no sound signal at the time of communication of noise canceling headphones or Bluetooth headphones with a communication function.

Although a technique of analyzing a reflected sound from an eardrum has also been proposed as in Japanese Unexamined Patent Application Publication No. 2009-232423, it is also difficult to execute this technique when the noise canceling headphones are used only for noise canceling (when the user does not listen to music or the like). In order to determine whether there is a reflected sound, an operation of outputting some sound from the driver is necessary and an operation opposite to noise canceling is necessary.

For example, there is also a form in which a user performs reading, sleep, or the like by blocking extraneous sounds using a noise canceling function of noise canceling headphones when aboard an airplane. However, considering the above-described use, the technique using a sound to be reproduced and output as in Japanese Unexamined Patent Application Publication Nos. 2009-207053 and 2009-232423 is not adopted.

It is desirable to provide a technique in which wearing/non-wearing of a headphone device can be appropriately detected in a technique in which accurate detection is possible even when a reproduction sound such as music is not output and in which the restrictions of a size and design rarely occur.

According to an embodiment of the present disclosure, there is provided a headphone device including an outside microphone attached to a position at which an extraneous sound is picked up without passing through a shield in a state in which a user is wearing the headphone device, an inside microphone attached to a position at which the extraneous sound is picked up via the shield in the state in which the user is wearing the headphone device, a driver unit configured to perform an acoustic output, and a wearing state detection unit. The wearing state detection unit is configured to detect a wearing state or a non-wearing state using a signal comparison result between a sound signal obtained by the outside microphone and a sound signal obtained by the inside microphone, a pre-stored non-wearing state reference value which is a signal comparison result between a sound signal obtained by the outside microphone and a sound signal obtained by the inside microphone when the extraneous sound arrives in the non-wearing state, and a pre-stored wearing state reference value which is a signal comparison result between a sound signal obtained by the outside microphone and a sound signal obtained by the inside microphone when the extraneous sound arrives in the wearing state.

According to an embodiment of the present disclosure, there is provided a wearing state detection method of a headphone device including an outside microphone attached to a position at which an extraneous sound is picked up without passing through a shield in a state in which a user is wearing the headphone device, an inside microphone attached to a position at which the extraneous sound is picked up via the shield in the state in which the user is wearing the headphone device, and a driver unit configured to perform an acoustic output, the wearing state detection method including detecting a wearing state or a non-wearing state using a signal comparison result between a sound signal obtained by the outside microphone and a sound signal obtained by the inside microphone, a pre-stored non-wearing state reference value which is a signal comparison result between a sound signal obtained by the outside microphone and a sound signal obtained by the inside microphone when the extraneous sound arrives in the non-wearing state, and a pre-stored wearing state reference value which is a signal comparison result between a sound signal obtained by the outside microphone and a sound signal obtained by the inside microphone when the extraneous sound arrives in the wearing state.

In the above-described present disclosure, wearing/non-wearing is detected using the fact that signal characteristics of an extraneous sound signal obtained by the inside microphone are different between the state in which the user is wearing the headphone device and the non-wearing state.

The inside microphone is attached to a position at which the extraneous sound is picked up via the shield in the state in which the user is wearing the headphone device. In this case, the shield, for example, is a headphone housing. That is, signal characteristics of the extraneous sound to be picked up by the inside microphone differ according to wearing/non-wearing. On the other hand, the outside microphone directly picks up the extraneous sound regardless of wearing/non-wearing.

Accordingly, in the non-wearing state, sound signals obtained by the inside microphone and the outside microphone ideally have similar characteristics. In the wearing state, sound signals obtained by the inside microphone and the outside microphone ideally exhibit different characteristics according to a difference between sound pickup paths (presence/absence of the shield).

Accordingly, the wearing state or the non-wearing state can be detected using the signal comparison result between the sound signal obtained by the outside microphone and the sound signal obtained by the inside microphone, the non-wearing state reference value, and the wearing state reference value.

According to the embodiments of the present disclosure described above, there is an advantageous effect in that it is possible to appropriately detect wearing/non-wearing of a headphone device in a technique in which the restrictions of a size and design rarely occur regardless of the presence/absence of input sound output execution from the headphone device.

DETAILED DESCRIPTION OF THE EMBODIMENT(S)

Figure 1:
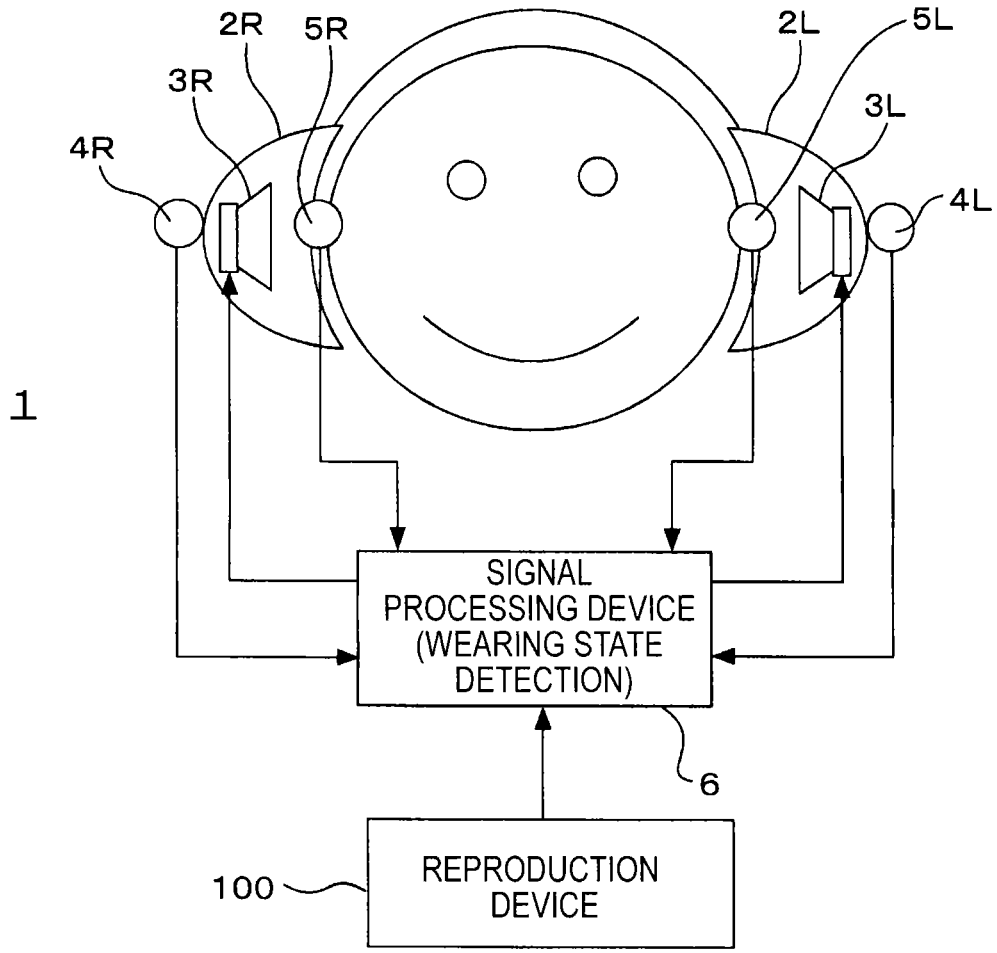
FIG. 1 is an explanatory diagram of headphones of an embodiment of the present disclosure.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

Hereinafter, the embodiments will be described in the following order.

<1. Headphone device configuration>

<2. First embodiment (FB type noise canceling system)>

[2-1: Signal processing device configuration]

[2-2: Wearing determination technique]

[2-3: Pre-measurement and wearing determination process]

<3. Second embodiment (FF type noise canceling system)>

<4. Third embodiment ((FF+FB) type noise canceling system)>

<5. Fourth embodiment (non-mounting of noise canceling system)>

<6. Fifth embodiment>

<7. Modified examples>

1. Headphone Device Configuration

FIG. 1 schematically illustrates a schematic configuration of headphones 1 of the embodiment.

The headphones 1 of the embodiment, for example, serve as an overhead sealed stereo headphone device, and have a left housing 2L and a right housing 2R to be worn on parts of left and right ears of a user.

A driver unit 3L configured to perform an acoustic output is provided within the left housing 2L, a driver unit 3R configured to perform an acoustic output is provided within the right housing 2R, and a stereo acoustic output is performed by driver units 3L and 3R.

In addition, in the left housing 2L in the headphones 1 of the embodiment, an outside microphone 4L in which a sound pickup hole is arranged toward the outside of the housing and an inside microphone 5L configured to pick up a sound inside the left housing 2L are provided.

Likewise, at the side of the right housing 2R, an outside microphone 4R in which a sound pickup hole is arranged toward the outside of the housing and an inside microphone 5R configured to pick up a sound inside the right housing 2R are provided.

In a state in which the user is wearing the headphones 1, inner spaces of the left and right housings 2L and 2R, that is, sound release spaces of the driver units 3L and 3R, serve as approximately sealed spaces for an outside space by the housings and the user's head.

Thus, the inside microphones 5L and 5R are set to be attached to positions at which an extraneous sound is picked up via shields (the housings 2L and 2R) in a state in which the user is wearing the headphones 1.

On the other hand, the outside microphones 4L and 4R are set to be attached to positions at which an extraneous sound is picked up without passing through the shields in the state in which the user is wearing the headphones 1.

In addition, the headphones 1 are so-called active headphones and have a signal processing device 6. Although this will be described later, the signal processing device 6 has a substrate on which a circuit unit is formed to perform sound signal processing or the like, a battery serving as an operation power supply, or the like.

Specifically, the substrate or the battery is housed in the housing 2L or 2R or housed in a state in which a housing is provided in the middle of a cord connected to a reproduction device or the like.

For example, upon listening to music or the like using the headphones 1, the user uses the headphones 1 by connecting the headphones 1 to a reproduction device 100. The reproduction device 100, for example, can be considered to be various devices such as a portable music player, a stationary music player, a portable phone, a personal computer, and a portable computer. That is, various devices configured to output a sound signal are assumed.

The sound signal reproduced by the reproduction device 100 is input to the signal processing device 6 of the headphones 1. After various processing has been performed, an acoustic output is generated as stereo sounds from the driver units 3L and 3R. In the signal processing device 6, acoustic treatment such as equalizing on an input reproduction sound signal is performed or a process for a noise canceling operation is performed.

In addition, the headphones 1 are used without being particularly connected to the reproduction device 100. In particular, when a noise canceling operation function is provided in the signal processing device 6, the user can obtain a state in which extraneous sounds have been significantly reduced by wearing the headphones 1. For example, there is also a use form in which the user desiring a quiet environment such as on an airplane or on a train merely wears the headphones 1, turns on a power supply, and executes a noise canceling operation.

2. First Embodiment

FB Type Noise Canceling System

[2-1: Signal Processing Device Configuration]

A configuration of the signal processing device 6 in the above-described headphones 1 of FIG. 1 will be mainly described.

A configuration example in which the FB type noise canceling system is mounted will be described as the first embodiment.

First, the configuration example of the first embodiment will be described with reference to FIG. 2.

Although only one of L and R channels is illustrated and described in description of the first to sixth embodiments, a configuration related to an input reproduction sound signal as a stereo type of headphones, a configuration for a noise canceling process, and a configuration for detecting wearing as will be described later are substantially the same in the other channel.

In addition, because only one channel is illustrated in the drawing, reference signs L and R as in "3L and 3R" illustrated in FIG. 1 are not assigned and notations such as a "driver unit 3," an "outside microphone 4," and an "inside microphone 5" are made without assigning "L" and "R."

In the first embodiment, an arithmetic unit 10, analog-to-digital (A/D) converters 11, 12, and 13, a power amplifier 14, a control unit 15, a power supply unit 16, an operation unit 17, and microphone amplifiers 18 and 19 are included as the signal processing device 6.

The arithmetic unit 10, for example, includes a digital signal processor (DSP) or the like, and performs an acoustic process, a noise canceling process, and a wearing detection process. Thus, the arithmetic unit 10 is configured to have functions as a reproduction sound signal processing unit 21, a noise canceling signal processing unit 22, an adder 23, a wearing state detection unit 24, and a memory 25.

The reproduction sound signal (music or the like) from the reproduction device 100 is input from an input terminal 7 and converted by the A/D converter 11 into a digital signal. The digital signal is input to the reproduction sound signal processing unit 21. The reproduction sound signal processing unit 21, for example, performs an equalizing process, sound volume processing, or the like for sound quality correction. Of course, acoustic effect processing such as reverb or echo may be performed.

The reproduction sound signal processed by the reproduction sound signal processing unit 21 is supplied to the power amplifier 14 via the adder 23 and amplified and an acoustic output is generated from the driver unit 3.

In the first embodiment, the FB type noise canceling system is mounted. Thus, the inside microphone 5 is used as a microphone for noise cancellation.

The A/D converter 13 converts the sound signal picked up by the inside microphone 5 and amplified by the microphone amplifier 18 into a digital signal, and supplies the digital signal to the noise canceling signal processing unit 22. The noise canceling signal processing unit 22 generates a noise canceling signal by performing a digital filtering process for noise cancellation on the picked-up sound signal.

The adder 23 adds the noise canceling signal to the reproduction sound signal, and an acoustic output is generated from the driver unit 3 via the power amplifier 14.

In the FB type noise canceling system, noise is picked up at an acoustic synthesis position at which noise and an acoustic reproduction sound of a sound signal are synthesized at a music listening position of the user (who is a person wearing the headphones 1). That is, the position is a front surface of a diaphragm of the driver unit 3, which is normally a position close to the ear.

Therefore, it is only necessary to use the inside microphone 5 as a microphone for noise sound pickup.

Accordingly, a reversed-phase component of extraneous noise picked up by the inside microphone 5 is generated by a filtering process of the noise cancelling signal processing unit 22, and subjected to acoustic reproduction as the noise canceling signal, so that a noise component input from the outside to the headphone housings 2L and 2R is reduced.

In addition, in the headphones 1 of the embodiment, it is detected whether the user is wearing the headphones 1.

Thus, the A/D converter 12 converts a sound signal picked up by the outside microphone 4 and amplified by the microphone amplifier 19 into a digital signal and supplies the digital signal to the wearing state detection unit 24. In addition, the A/D converter 13 converts a sound signal picked up by the inside microphone 5 and amplified by the microphone amplifier 18 into a digital signal and supplies the digital signal to the wearing state detection unit 24. Further, a reproduction sound signal converted by the A/D converter 11 into a digital signal is also supplied.

In addition, the wearing state detection unit 24 is configured to refer to a wearing state reference value and a non-wearing state reference value stored in the memory 25.

The wearing state detection unit 24 performs a signal comparison between a sound signal obtained by the outside microphone 4 and a sound signal obtained by the inside microphone 5. Accordingly, a wearing determination is made using the signal comparison result and the wearing state reference value and the non-wearing state reference value stored in the memory 25.

The wearing state reference value is an ideal value of the signal comparison result between the sound signal obtained by the outside microphone 4 and the sound signal obtained by the inside microphone 5 when an extraneous sound arrives in a state in which the user is wearing the headphones 1. This is pre-measured and stored in the memory 25.

The non-wearing state reference value is an ideal value of the signal comparison result between the sound signal obtained by the outside microphone 4 and the sound signal obtained by the inside microphone 5 when an extraneous sound arrives in a non-wearing state in which the user is not wearing the headphones 1. This is also pre-measured and stored in the memory 25.

The wearing state detection unit 24 sequentially performs a signal comparison between the sound signal obtained by the outside microphone 4 and the sound signal obtained by the inside microphone 5. From the signal comparison result, it is detected whether the state is the wearing state or the non-wearing state by making each similarity determination with the non-wearing state reference value and the wearing state reference value. Accordingly, the wearing state detection unit 24 outputs a wearing detection signal Sdet indicating the wearing/non-wearing detection result to the control unit 15.

The control unit 15, for example, includes a microcomputer, and outputs a control signal Sc to each part of the signal processing device 6 of the headphones 1 to perform necessary control.

For example, for the arithmetic unit 10, indications of equalizing coefficients corresponding to various modes in the reproduction sound signal processing unit 21, setting of a filter coefficient in the noise canceling signal processing unit 22, ON/OFF control of a noise canceling function, and the like are performed.

As a filtering process for noise canceling, variable setting may be performed according to an external environment (noise canceling mode). For example, the filter coefficient may be switched so that a noise canceling operation suitable for a noise environment such as within a train, within an airplane, and outdoor is performed. In this case, the control unit 15 also sets the filter coefficient according to the noise canceling mode.

In addition, the control unit 15 controls power supply ON/OFF for the power supply unit 16.

The power supply unit 16 uses a built-in battery as a power supply, and supplies an operation power supply voltage Vdd to each part. ON/OFF of supply of the power supply voltage Vdd (power supply ON/OFF of the headphones 1) is performed based on an instruction from the control unit 15.

As the operation unit 17, an operation element to be used by the user is provided. For example, a power supply button, a mode button (an operation element of an acoustic mode or the noise canceling mode) or the like is provided.

The control unit 15 instructs the power supply unit 16 to turn on/off the power supply according to an operation of the power supply button. In addition, the control unit 15 indicates a processing mode of the arithmetic unit 10 according to an operation of the mode button.

Also, the headphones 1 of the embodiment may be a type in which the headphones 1 are connected to the reproduction device 100 by wire or wirelessly.

In the case of the wireless connection type, a reception unit is configured to be provided in a previous stage of the A/D converter 11.

[2-2: Wearing Determination Technique]

A wearing determination technique in the headphones 1 of the above configuration will be described in detail.

Figure 3:
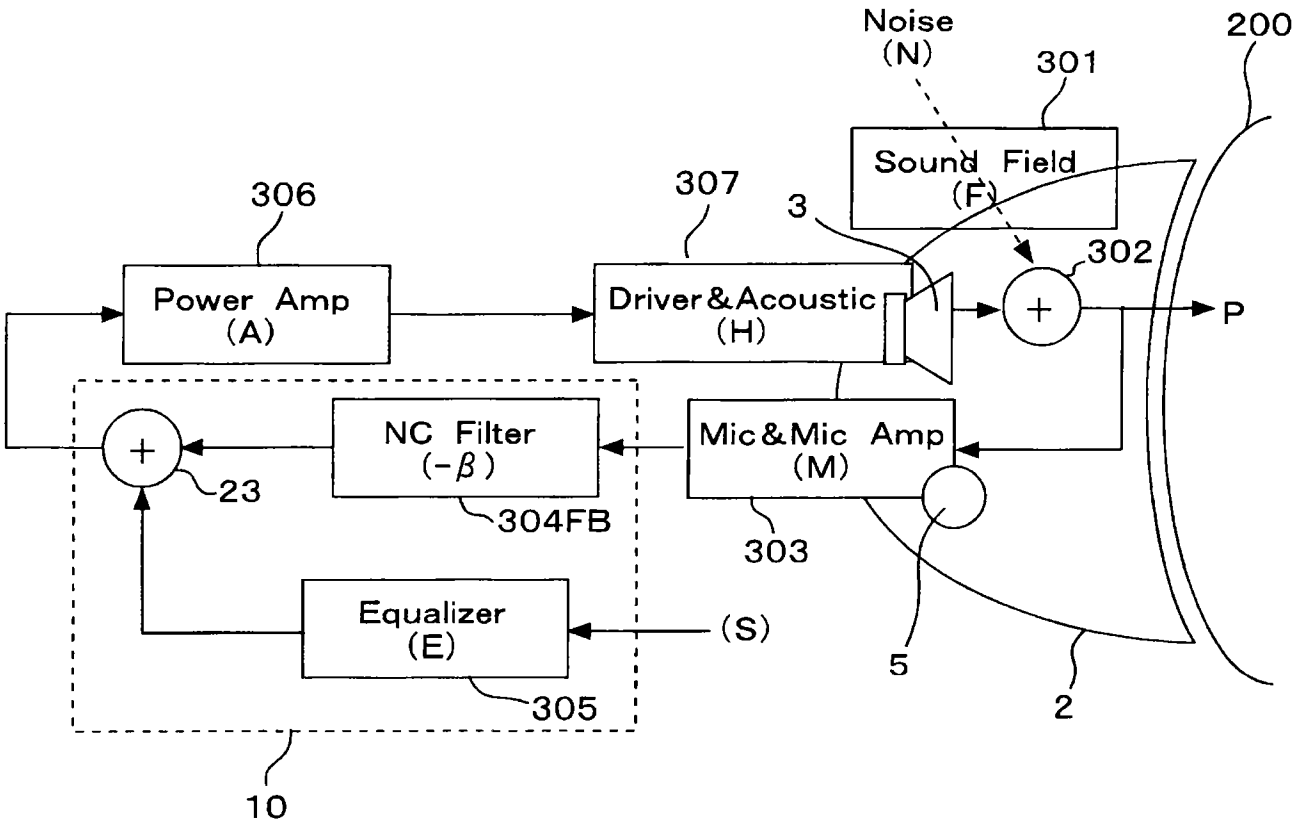
FIG. 3 is an explanatory diagram of a feedback (FB) type noise canceling system of the first embodiment.

FIG. 3 illustrates characteristics of parts in the first embodiment in which the FB type noise canceling system has been mounted.

The headphones 1 (housings 2) are worn on the user's head (auricles) 200. Illustrated characteristics are as follows.

A sound field 301 represents an acoustic path along which extraneous noise from a sound source N reaches the inside microphone 5 and the outside microphone 4. Also, although described with reference to FIG. 4, it is assumed that "F" or "F'" denotes an acoustic path and acoustic characteristics are denoted by "$F_0$" or "$F_1$."

An adder 302 exhibits spatial synthesis of an output sound from the driver unit 3 and extraneous noise. Spatially synthesized sound pressure (sound pressure heard by the user) is denoted by "P."

A microphone and microphone amplifier 303 represent a sound pickup sound signal path of the inside microphone 5 and the microphone amplifier 18. A sound signal characteristic of the microphone and microphone amplifier 303 is referred to as "M."

A noise canceling (NC) filter 304FB exhibits a filtering process for noise canceling signal generation of the noise canceling signal processing unit 22 in the arithmetic unit 10. A filtering characteristic is referred to as "$-\beta$."

An equalizer 305 exhibits an equalizing process to be performed by the reproduction sound signal processing unit 21 in the arithmetic unit 10. This processing characteristic is referred to as "E." Also, an input reproduction sound signal is referred to as "S."

A power amplifier 306 exhibits an amplification process in the power amplifier 14. Its characteristic is referred to as "A."

A driver and acoustic 307 exhibit the driver unit 3 and an output sound path as a sound release space. An acoustic characteristic thereof is referred to as "H."

First, sound signals obtained by the inside microphone 5 and the outside microphone 4 when the reproduction sound signal S is not input from the reproduction device 100 as the assumption of the above characteristics will be described with reference to FIG. 4.

Figure 4:
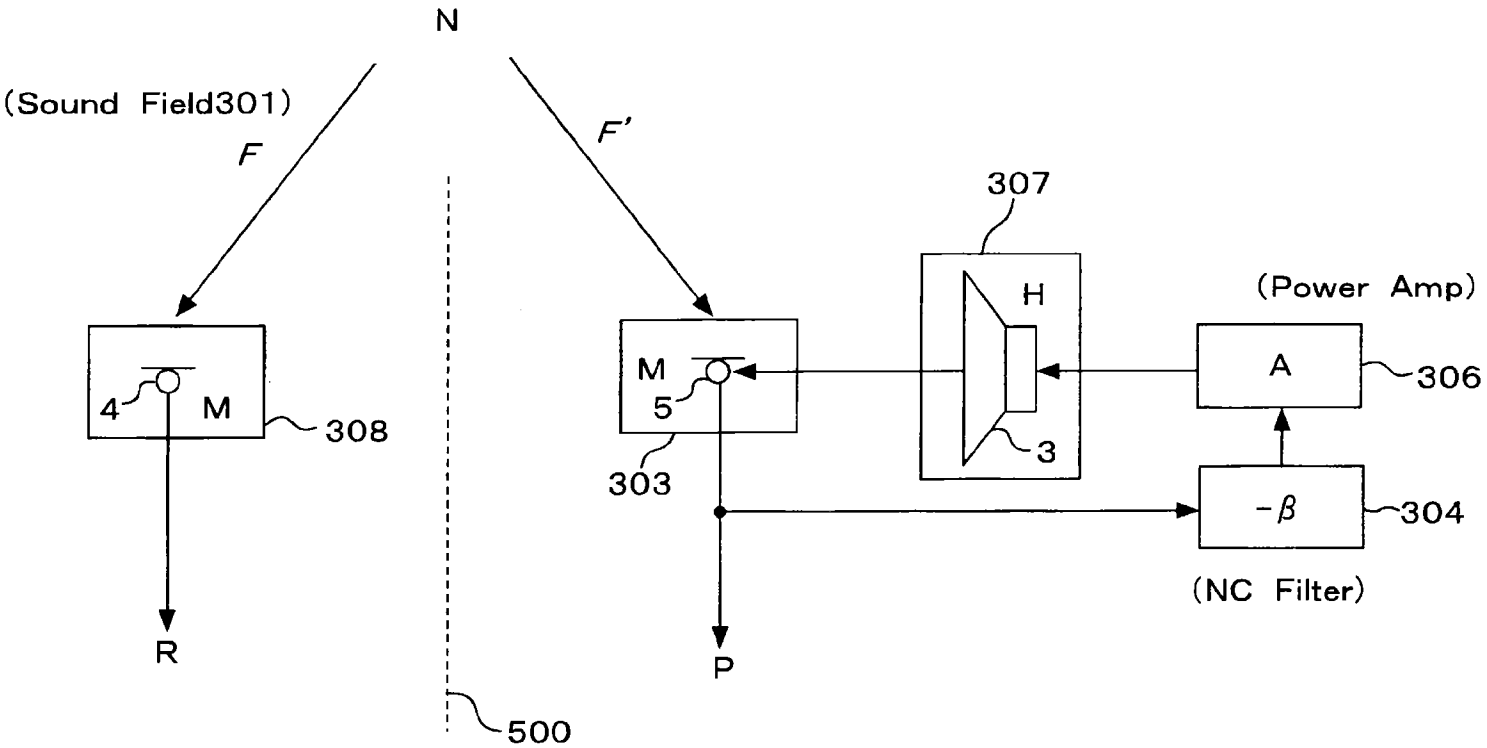
FIG. 4 is an explanatory diagram of characteristics of parts when no reproduction sound of the first embodiment is input.

In FIG. 4, the left side from a dotted line 500 serves as an outside sound signal system of the housing 2, and the right side serves as an inside sound signal system of the housing 2. In this case, the right side from the dotted line 500 serves as an element of the FB type noise canceling system as in FIG. 3, and the left side from the dotted line 500 does not serve as an element of the noise canceling system.

Here, the acoustic path F and the acoustic path F' are shown as the sound field 301.

The acoustic path F is a name of an acoustic path from the sound source N (outside noise sound source) to the outside microphone 4, and the acoustic path F' is a name of an acoustic path from the sound source N to the inside microphone 5.

Here, the case in which the inside microphone 5 and the outside microphone 4 having the same characteristics are used is considered.

The microphone and microphone amplifier 303 are a sound pickup sound signal path of the inside microphone 5 and the microphone amplifier 18 as described above, and a microphone and microphone amplifier 308 are a sound pickup sound signal path of the outside microphone 4 and the microphone amplifier 19. Both characteristics are referred to as "M."

Although "P" is sound pressure heard by the user as described above, this becomes sound pressure picked up by the inside microphone 5 as illustrated in FIG. 4.

"R" denotes sound pressure picked up by the outside microphone 4.

There are two types of characteristics from the sound source N to the inside microphone 5 and the outside microphone 4.

A characteristic when there is no shield is referred to as "$F_0$" and a characteristic when there is a shield (the headphones are mounted) is referred to as "$F_1$."

That is, a characteristic of the acoustic path F from the sound source N of the extraneous sound to the outside microphone 4 is constantly "$F_0$." On the other hand, a characteristic of the acoustic path F' from the sound source N of the extraneous sound to the inside microphone 5 may be "$F_0$" (non-wearing state) or "$F_1$" (wearing state).

Likewise, in the characteristic "H" of the driver and acoustic 307, the non-wearing state is referred to as "$H_0$" and the wearing state is referred to as "$H_1$."

The characteristics "$F_0$," "$F_1$," "$H_0$," and "$H_1$" are premeasured, and each characteristic can be obtained.

Here, Equations (1) to (7) are referred to.

$$P = F'MN - AHM\beta P \tag{1}$$

$$(1 + AMH\beta)P = F'MN \tag{2}$$

$$Q_0 = (1 + AH_0M\beta)P = F_0MN \tag{3}$$

$$Q_1 = (1 + AH_1M\beta)P = F_1MN \tag{4}$$

$$R = F_0MN \tag{5}$$

$$\frac{Q_0}{R} = \frac{F_0MN}{F_0MN} = 1 \tag{6}$$

$$\frac{Q_1}{R} = \frac{F_1MN}{F_0MN} = \frac{F_1}{F_0} \tag{7}$$

Sound pressure P serving as a result of sound pickup in the inside microphone 5 in the state of FIG. 4 is expressed in Equation (1). Also, in Equation (1), "F'" is shown in an acoustic path name for convenience in a meaning of either the characteristic "$F_0$" or "$F_1$." In addition, the characteristic "H" of the driver and acoustic 307 is either "$H_0$" or "$H_1$."

Equation (2) is a modification of Equation (1).

Here, Equations (3) and (4) are obtained in consideration of each of the non-wearing state and the wearing state.

Because the characteristic of the sound field 301 is "$F_0$" and the characteristic of the driver and acoustic 307 is "$H_0$" in the non-wearing state, Equation (3) is obtained from Equation (2). Equation (3) represents a sound pickup sound pressure characteristic "$Q_0$" of the inside microphone 5 of the non-wearing state.

Because the characteristic of the sound field 301 is "$F_1$" and the characteristic of the driver and acoustic 307 is "$H_1$" in the wearing state, Equation (4) is obtained from Equation (2). Equation (4) represents a sound pickup sound pressure characteristic "$Q_1$" of the inside microphone 5 of the wearing state.

On the other hand, sound pressure R of a result of sound pickup by the outside microphone 4 is expressed in Equation (5). This is because the characteristic of the sound field 301 is constantly "$F_0$" and is not related to the noise canceling system.

When a ratio of the sound pressures "R" and "Q" obtained by the microphones 4 and 5 have been calculated, the ideal equation of the non-wearing state becomes Equation (6), the ideal equation of the wearing state becomes Equation (7), and these are constants.

Using the constants serving as the above Equations (6) and (7), wearing can be detected when the headphones 1 are used.

A value of $(Q_0/R)=1$ of Equation (6) becomes the above-described non-wearing state reference value.

A value of $(Q_1/R)=(F_1/F_0)$ of Equation (7) becomes the above-described wearing state reference value.

It is assumed that these values are saved in the memory 25 based on measurement performed in advance.

When the headphones 1 are in operation, the following operation is performed. Equations (8) to (11) are referred to.

$$T_0 = f_0(P, R) = (1 + AH_0M\beta)\frac{P}{R} \tag{8}$$

$$T_1 = f_1(P, R) = (1 + AH_1M\beta)\frac{F_1}{F_0}\frac{P}{R} \tag{9}$$

$$d_0 = |1 - T_0| \tag{10}$$

$$d_1 = \left|\frac{F_1}{F_0} - T_1\right| \tag{11}$$

When the headphones 1 are in operation, "$T_0$" and "$T_1$" of Equations (8) and (9) are calculated constantly from the signal "P" picked up by the inside microphone and the signal "R" picked up by the outside microphone 4.

The calculated value $T_0$ of Equation (8) is a value of a signal comparison result between a sound signal obtained by the outside microphone 4 and a sound signal obtained by the inside microphone 5 when the non-wearing state has been assumed.

When the state is actually the non-wearing state, the calculated value $T_0$ of Equation (8) is equal to the non-wearing state reference value (=1) of Equation (6) as long as the ideal condition is given.

In addition, the calculated value $T_1$ of Equation (9) is a value of a signal comparison result between a sound signal obtained by the outside microphone 4 and a sound signal obtained by the inside microphone 5 when the wearing state has been assumed.

When the state is actually the wearing state, the calculated value $T_1$ of Equation (9) is equal to the wearing state reference value $(=F_1/F_0)$ of Equation (7) as long as the ideal condition is given.

Accordingly, distances from ideal values for the calculated values "$T_0$" and "$T_1$" of Equations (8) and (9) are obtained.

A distance $d_0$ of Equation (10) represents a distance between the calculated value $T_0$ of Equation (8) and the non-wearing state reference value (=1).

A distance $d_1$ of Equation (11) represents a distance between the calculated value $T_1$ of Equation (9) and the wearing state reference value ($=F_1/F_0$).

Accordingly, the distances $d_0$ and $d_1$ are compared.

If $d_0<d_1$, the state is determined to be the non-wearing state. If $d_0 \geq d_1$, the state is determined to be the wearing state.

If $d_0<d_1$, the state can be determined to be the non-wearing state because the similarity of the non-wearing state reference value with the signal comparison result between the sound signal obtained by the outside microphone 4 and the sound signal obtained by the inside microphone 5 when the non-wearing state has been assumed is higher than the similarity of the wearing state reference value with the signal comparison result between the sound signal obtained by the outside microphone 4 and the sound signal obtained by the inside microphone 5 when the wearing state has been assumed. The case of $d_0 \geq d_1$ is opposite thereto.

That is, currently (during the wearing determination process), wearing/non-wearing can be determined by determining the similarity (distance) with the non-wearing state reference value and the wearing state reference value for the signal comparison result between the sound signal obtained by the outside microphone 4 and the sound signal obtained by the inside microphone 5.

Figure 5:
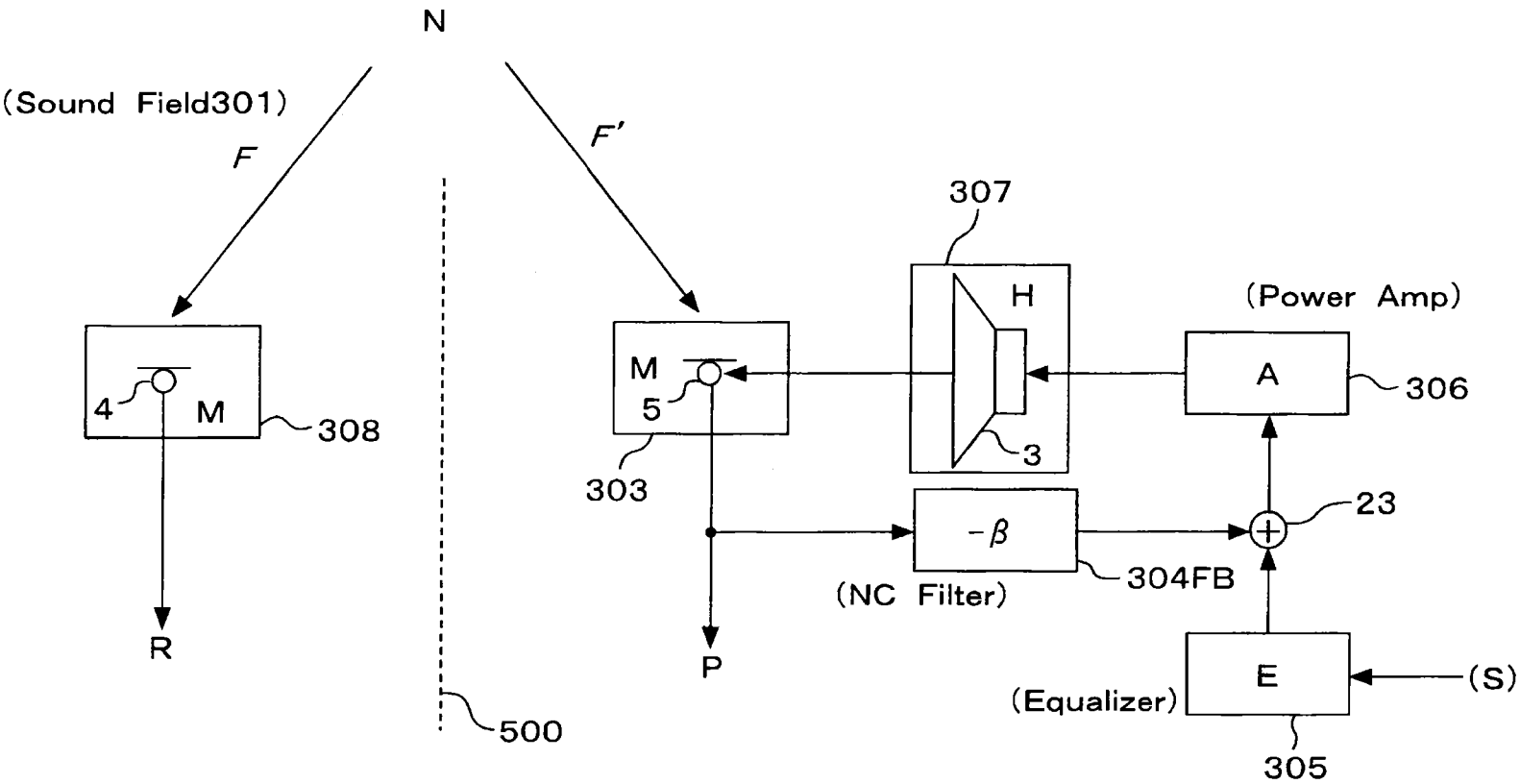
FIG. 5 is an explanatory diagram of characteristics of parts when a reproduction sound of the first embodiment is input.

Although the case in which no reproduction sound signal is input to the input terminal 7 has been described above, FIG. 4 becomes like FIG. 5 when an input of a reproduction sound signal S is considered.

That is, a signal processing characteristic "E" in the equalizer 305 is given for the reproduction sound signal S. The adder 23 adds the signal processing characteristic "E" to a noise canceling signal (an output of the NC filter 304FB).

Then, equations based on the concept similar to the above are as follows.

$$P = F'MN - AHM\beta P + EAHMS \tag{12}$$

$$P = \frac{F'M}{1 + AHM\beta}N + \frac{EAHM}{1 + AHM\beta}S \tag{13}$$

$$P_0 = \frac{F_0M}{1 + AH_0M\beta}N + \frac{EAH_0M}{1 + AH_0M\beta}S \tag{14}$$

$$P_1 = \frac{F_1M}{1 + AH_1M\beta}N + \frac{EAH_1M}{1 + AH_1M\beta}S \tag{15}$$

$$Q_0 = \left(P_0 - \frac{EAH_0M}{1 + AH_0M\beta}S\right)(1 + AH_0M\beta) = (1 + AH_0M\beta)P_0 - EAH_0MS = F_0MN \tag{16}$$

$$Q_1 = \left(P_1 - \frac{EAH_1M}{1 + AH_1M\beta}S\right)(1 + AH_1M\beta) = (1 + AH_1M\beta)P_1 - EAH_1MS = F_1MN \tag{17}$$

$$R = F_0MN \tag{18}$$

$$\frac{Q_0}{R} = \frac{F_0MN}{F_0MN} = 1 \tag{19}$$

$$\frac{Q_1}{R} = \frac{F_1MN}{F_0MN} = \frac{F_1}{F_0} \tag{20}$$

Equation (12) is an equation of sound pressure P picked up by the inside microphone 5.

Equation (13) is obtained by modifying Equation (12) into the term of the noise sound source N and the term of the reproduction sound S.

In Equations (12) and (13), as the above-described Equations (1) and (2), "F'" is either the characteristic "$F_0$" or "$F_1$" and "H" is either the characteristic "$H_0$" or "$H_1$."

The equation of $P_0$ of Equation (14) is a modification of Equation (13) by setting "F'"="$F_0$" and "H"="$H_0$" under the assumption of the non-wearing state.

The equation of $P_1$ of Equation (15) is a modification of Equation (13) by setting "F'"="$F_1$" and "H"="$H_1$" under the assumption of the wearing state.

Equation (16) represents a sound pickup sound pressure characteristic "$Q_0$" of the inside microphone 5 in the non-wearing state by modifying Equation (14).

Equation (17) represents a sound pickup sound pressure characteristic "$Q_1$" of the inside microphone 5 in the wearing state by modifying Equation (15).

On the other hand, sound pressure R picked up by the outside microphone 4 becomes Equation (18).

When a ratio of the sound pressures "R" and "Q" obtained by the microphones 4 and 5 has been calculated, the ideal equation of the non-wearing state becomes Equation (19) and the ideal equation of the wearing state becomes Equation (20). These become constants and are equal to the above-described Equations (6) and (7).

Accordingly, it is possible to perform wearing detection when the headphones 1 are used using constants serving as Equations (19) and (20).

A value of $(Q_0/R)=1$ of Equation (19) becomes the non-wearing state reference value, and a value of $(Q_1/R)=(F_1/F_0)$ of Equation (20) becomes the wearing state reference value.

It is assumed that these values are saved in the memory 25 based on measurement performed in advance.

When the headphones 1 are in operation, the following operation is performed. Equations (21) to (24) are referred to.

$$T_0 = f_0(P, R, S) = \frac{1 + AH_0M\beta}{R}P - \frac{EAH_0M}{R}S \tag{21}$$

$$T_1 = f_1(P, R, S)\frac{1 + AH_1M\beta}{R}P - \frac{EAH_1M}{R}S \tag{22}$$

$$d_0 = |1 - T_0| \tag{23}$$

$$d_1 = \left|\frac{F_1}{F_0} - T_1\right| \tag{24}$$

When the headphones 1 are in operation, "$T_0$" and "$T_1$" of Equations (21) and (22) are calculated constantly from the signal "P" picked up by the inside microphone 5 and the signal "R" picked up by the outside microphone 4.

The calculated value $T_0$ of Equation (21) is a value of a signal comparison result between a sound signal obtained by the outside microphone 4 and a sound signal obtained by the inside microphone 5 when the non-wearing state has been assumed.

When the state is actually the non-wearing state, the calculated value $T_0$ of Equation (21) is equal to the non-wearing state reference value (=1) of Equation (19) as long as the ideal condition is given.

In addition, the calculated value $T_1$ of Equation (22) is a value of a signal comparison result between a sound signal obtained by the outside microphone 4 and a sound signal obtained by the inside microphone 5 when the wearing state has been assumed.

When the state is actually the wearing state, the calculated value $T_1$ of Equation (22) is equal to the wearing state reference value ($=F_1/F_0$) of Equation (20) as long as the ideal condition is given.

Accordingly, distances $d_0$ and $d_1$ from ideal values as in Equations (23) and (24) are obtained for the calculated values "$T_0$" and "$T_1$" of Equations (21) and (22).

A distance $d_0$ of Equation (23) represents a distance between the calculated value $T_0$ of Equation (21) and the non-wearing state reference value (=1).

A distance $d_1$ of Equation (24) represents a distance between the calculated value $T_1$ of Equation (22) and the wearing state reference value ($=F_1/F_0$). Accordingly, the distances $d_0$ and $d_1$ are compared.

If $d_0<d_1$, the state is determined to be the non-wearing state. If $d_0 \geq d_1$, the state is determined to be the wearing state.

That is, currently (during the wearing state determination process), wearing/non-wearing can be determined by determining the similarity (distance) with the non-wearing state reference value and the wearing state reference value for the signal comparison result between the sound signal obtained by the outside microphone 4 and the sound signal obtained by the inside microphone 5.

Even when the headphones 1 generate an acoustic output of a reproduction sound such as music as described above, it is understood that the wearing state detection can be ultimately performed as in the case in which there is no reproduction sound.

In the actual headphones 1, it is only necessary to detect the wearing state in the concept described with reference to the above-described Equations (12) to (24). That is, it is only necessary to perform the calculations of Equations (21) and (22) as a real-time process while the headphones operate. Because Equations (21) and (22) are equivalent to Equations (8) and (9) when no reproduction sound signal S is input, it can be seen that it is not necessary to determine the presence/absence of the input of the reproduction sound signal and it is only necessary to constantly calculate Equations (21) and (22).

As the real-time process, the case in which Equations (21) and (22) are calculated by detecting the presence/absence of a reproduction sound signal input from the reproduction device 100 and the case in which Equations (8) and (9) are calculated may be switched.

In addition, when the distances $d_0$ and $d_1$ obtained by Equations (23) and (24) are ultimately compared, $(d_0 \cdot {}_0)$ and $(d_1 \cdot k_1)$ may be compared using coefficients.

According to setting of the coefficients $k_0$ and $k_1$, adjustment such as "the non-wearing state is determined with maximum leniency" or "the non-wearing state is determined with maximum stringency" is possible.

For example, although this will be described later, it is necessary to perform power supply OFF control suitable for a use situation in the case in which the control unit 15 performs the power supply OFF control when the non-wearing state has been detected as the determination result.

According to an individual difference of the wearing state of the headphones 1, an external noise situation, or the like, the state may easily be erroneously determined to be the non-wearing state even when the user is wearing and using the headphones 1. Accordingly, for example, during music appreciation, during noise canceling (in use as earplugs), or the like, it is preferred that the non-wearing state not be frequently erroneously detected and the power supply turned off. Considering the above, it is appropriate to determine the non-wearing state with maximum stringency according to coefficient setting.

On the other hand, if there is no concern of the erroneous determination, the non-wearing state may be determined with maximum leniency according to coefficient setting from the concept of avoiding battery consumption in the non-wearing state.

[2-3: Pre-Measurement and Wearing Determination Process]

Hereinafter, a specific process of a wearing determination based on the above-described concept will be described.

First, $Q_1/R(=F_1/F_0)$ of the wearing state reference value and $Q_0/R$ (=1) of the non-wearing state reference value to be stored in advance will be described.

When wearing is actually determined in the above-described concept in the headphones 1, an ideal wearing state and an ideal non-wearing state are prescribed and environments thereof are measured in advance, so that the non-wearing state reference value and the wearing state reference value are obtained according to equations (Equations (19) and (20)) serving as the reference corresponding to a noise canceling scheme.

Figure 6:
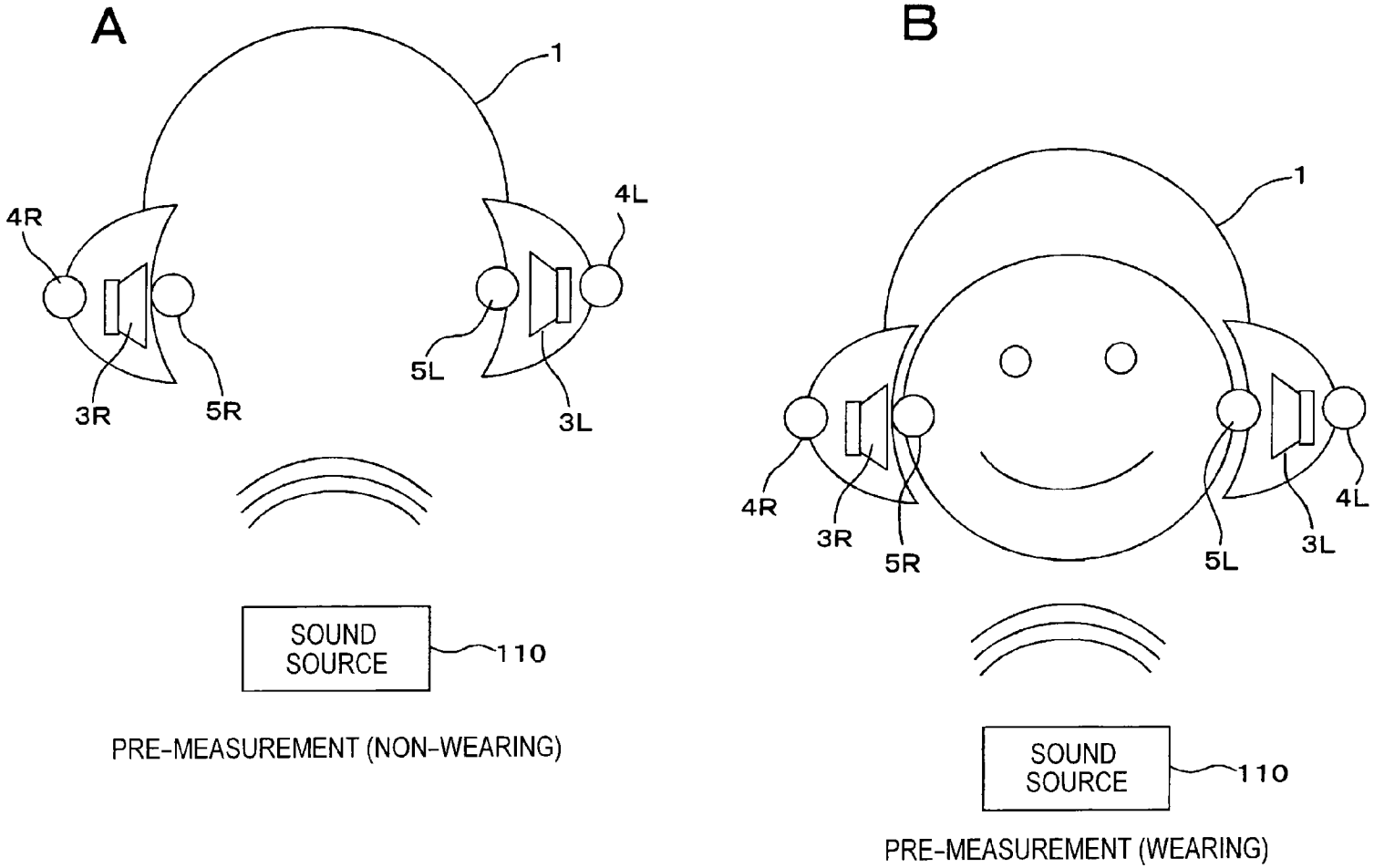
FIGS. 6A and 6B are explanatory diagrams of pre-measurement of reference characteristics of an embodiment.

States of pre-measurement are illustrated in FIGS. 6A and 6B. FIG. 6A illustrates measurement in the non-wearing state, and FIG. 6B illustrates measurement in the wearing state.

White noise (or pink noise or a pseudo-noise signal) is generated by placing the sound source 110 such as a speaker in the midline at the time of measurement.

In the case of measurement in the wearing state of FIG. 6B, for example, measurement is performed by a specified dummy head as the ideal wearing state. Alternatively, an average of characteristics may be used by having a plurality of persons wear headphones and performing measurement.

FIG. 7A illustrates a frequency characteristic serving as the non-wearing state reference value $Q_0/R$ (=1) and a frequency characteristic serving as the wearing state reference value $Q_1/R$ ($=F_1/F_0$).

For example, as in this drawing, the frequency characteristics are measured and frequency characteristic measurement results are set as the non-wearing state reference value and the wearing state reference value.

Figure 8:
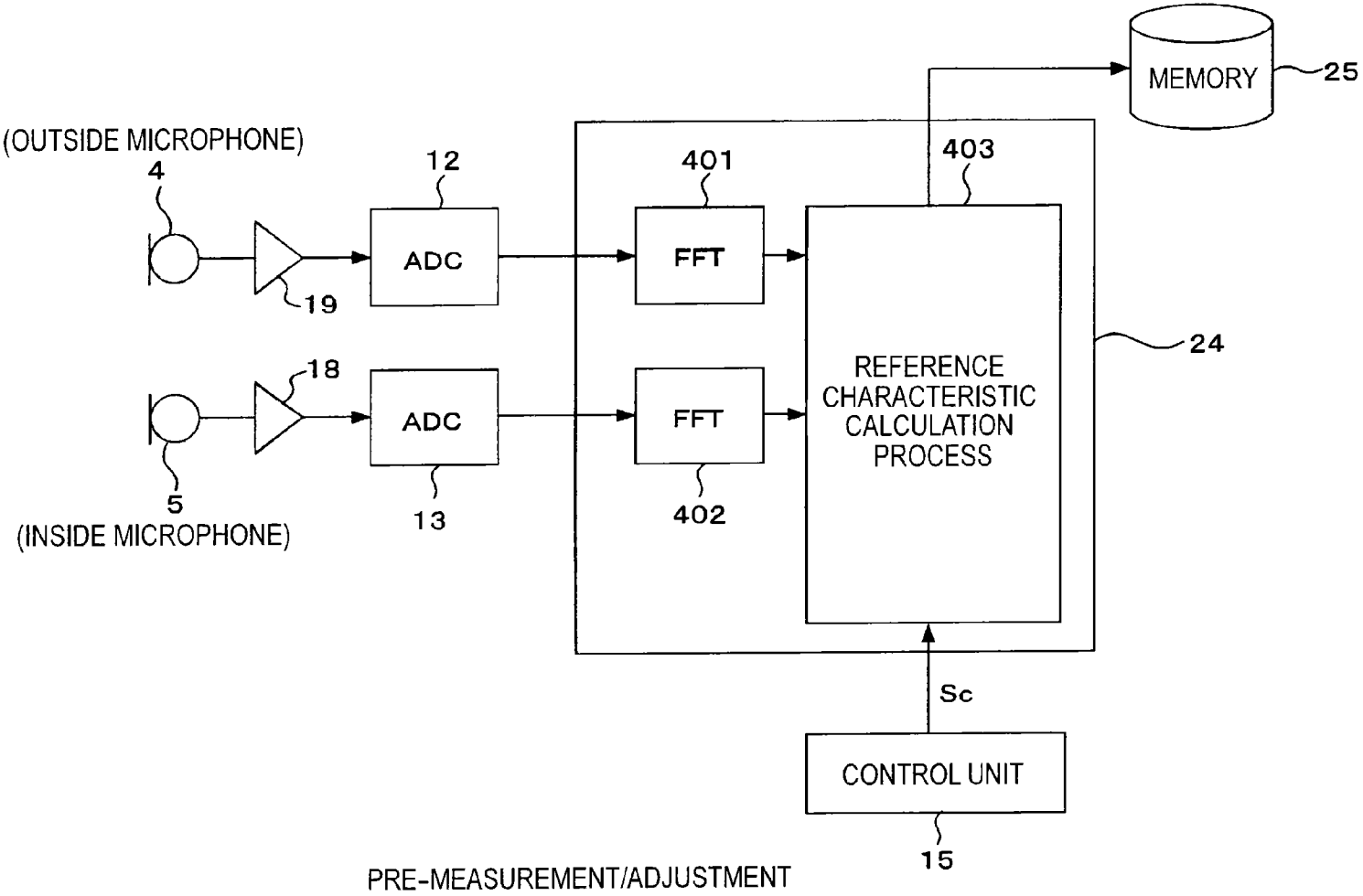
FIG. 8 is an explanatory diagram of a pre-measurement operation of an embodiment.

FIG. 8 illustrates a processing example of the wearing state detection unit 24 for performing the above-described pre-measurement.

The control unit 15 instructs the wearing state detection unit 24 of the arithmetic unit 10 to execute reference characteristic calculation operations for the non-wearing state reference value and the wearing state reference value according to a control signal Sc.

In this case, the wearing state detection unit 24 is set to perform fast Fourier transform (FFT) processes 401 and 402 and a reference characteristic calculation process 403.

First, in measurement of the non-wearing state of FIG. 6A, the wearing state detection unit 24 performs the FFT process 401 on a sound signal picked up by the outside microphone 4 and input via the microphone amplifier 19 and the A/D converter 12. In addition, the wearing state detection unit 24 performs the FFT process 402 on a sound signal picked up by the inside microphone 5 and input via the microphone amplifier 18 and the A/D converter 13.

Accordingly, the wearing state detection unit 24 performs the reference characteristic calculation process 403 on results of the FFT processes 401 and 402. The result of the FFT process 401 is a frequency characteristic for the above-described sound pressure R, and the result of the FFT process 402 is a frequency characteristic for the above-described sound pressure P.

In the reference characteristic calculation process 403, amplitudes of the frequency characteristics for the above-described "P" and "R" are compared. Ultimately, as in FIG. 7A at the time of measurement in the non-wearing state of FIG. 6A, the non-wearing state reference value (=1) shown in Equation (19) is given. In addition, as in FIG. 7B at the time of measurement in the wearing state of FIG. 6B, the wearing state reference value ($=F_1/F_0$) shown in Equation (20) is given.

The wearing state detection unit 24 causes the above-described reference values to be stored in the memory 25.

After the above-described pre-storage, wearing is determined in actual use.

Figure 9:
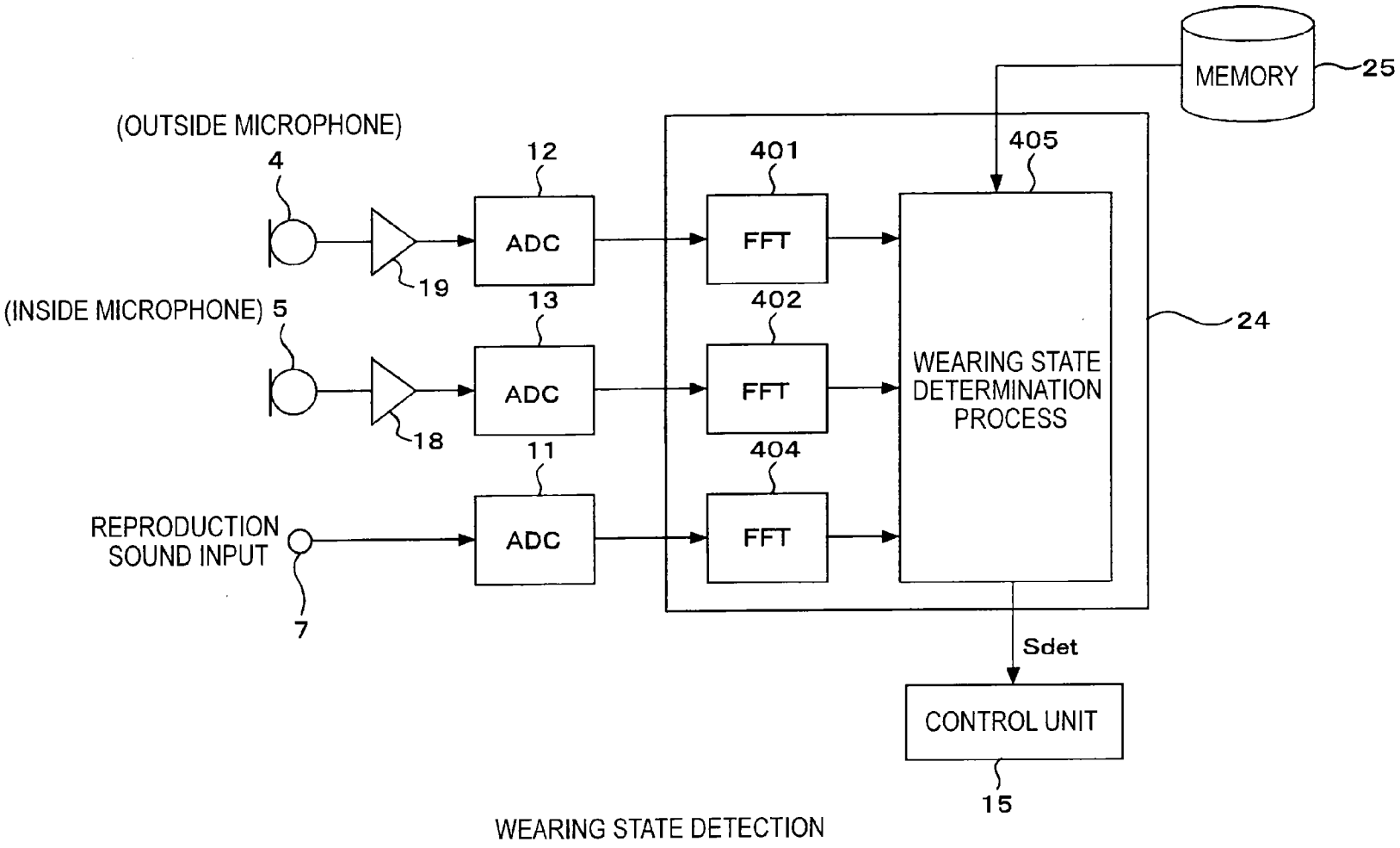
FIG. 9 is an explanatory diagram of a wearing state detection operation of an embodiment.

FIG. 9 illustrates a process when the wearing state is determined. The wearing state detection unit 24 performs FFT processes 401, 402, and 404 and a wearing state determination process 405.

In order to determine wearing when the headphones are used, the wearing state detection unit 24 performs the FFT process 401 on a sound signal picked up by the outside microphone 4 and input via the microphone amplifier 19 and the A/D converter 12. In addition, the wearing state detection unit 24 performs the FFT process 402 on a sound signal picked up by the inside microphone 5 and input via the microphone amplifier 18 and the A/D converter 13. Further, the FFT process 404 on a reproduction sound signal input to the input terminal 7 and passing through the A/D converter 11 is also performed.

A result of the FFT process 401 is a frequency characteristic of "R" described above. A result of the FFT process 402 is a frequency characteristic of "P" described above. A result of the FFT process 404 is a frequency characteristic of "S" described above.

In the wearing state determination process 405, the above-described Equations (21) and (22) are calculated using the results (the frequency characteristics of "P," "R," and "S").

Accordingly, wearing is determined using the calculated $T_0$ and $T_1$ obtained by Equations (21) and (22) and the non-wearing state reference value and the wearing state reference value from the memory 25. That is, the distances $d_0$ and $d_1$ are obtained by Equations (23) and (24), and the wearing state/non-wearing state is determined by the comparison result.

That is, amplitudes are compared by performing frequency analysis on a sound pickup signal P of the inside microphone 5 and a sound pickup signal R of the outside microphone 4 in real time at a given interval. Accordingly, it is determined whether the comparison result is closer to the frequency characteristic of the wearing state reference value of the pre-measurement result or the frequency characteristic of the non-wearing state reference value. In FIG. 7B, a comparison between the calculated value $T_0$ and the non-wearing state reference value and a comparison between the calculated value $T_1$ and the wearing state reference value are illustrated. The distances $d_0$ and $d_1$ are obtained from these comparisons.

As an actual comparison method, for example, the comparison is performed by calculating an area of an amplitude difference on a frequency axis for each of the assumption of the non-wearing state and the assumption of the wearing state of FIG. 7B. That is, a difference area between a $T_0$ frequency characteristic curve and a frequency characteristic curve (1 in all bands) of the non-wearing state reference value is compared to a difference area between a $T_1$ frequency characteristic curve and an $F_1/F_0$ frequency characteristic curve of the wearing state reference value.

Alternatively, the comparison may be performed by focusing on characteristic frequencies and calculating a sum or average of amplitude differences (or ratios).

In addition, for example, an area of an amplitude difference on the frequency axis as in FIG. 7B may be calculated and compared with a threshold value or a sum or average of amplitude differences (or ratios) may be calculated and compared to a threshold value by focusing on a characteristic frequency.

The wearing state detection unit 24 can immediately notify the control unit 15 of the determination result obtained in the above-described process as the final result. However, for example, the number of samples is increased to obtain certainty of the wearing/non-wearing detection when a process of automatically turning off the power supply by recognizing that an operation of turning off the power supply is forgotten in the non-wearing state is performed or the final result may indicate the non-wearing state when the non-wearing state determination reaches the prescribed number of consecutive times or reaches a prescribed ratio.

Figure 10:
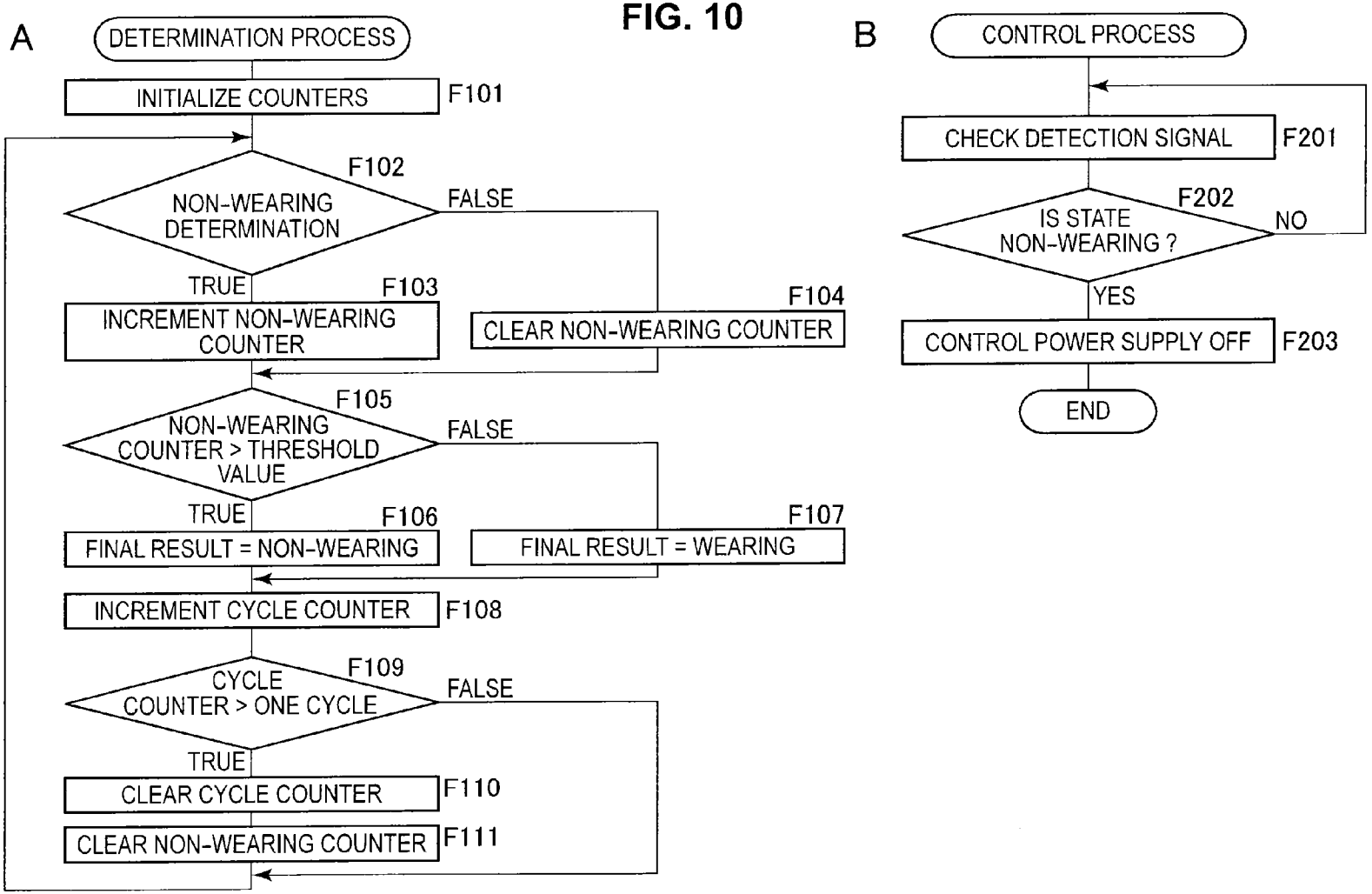
FIGS. 10A and 10B are flowcharts of a wearing determination process and a power supply control process of an embodiment.

It is only necessary for the wearing state detection unit 24 to perform a process as in FIG. 10A.

FIG. 10A illustrates a processing example as the wearing state determination process 405 of the wearing state detection unit 24.

The wearing state detection unit 24 initializes counters in step F101. For example, a cycle counter and a non-wearing counter are initialized. The cycle counter is a counter that counts one cycle as a given detection unit time. The non-wearing counter is a counter that counts a continuation time of a state in which the state is detected to be the non-wearing state.

In step F102, the wearing state detection unit 24 determines wearing/non-wearing according to the above-described technique. Accordingly, when the state is determined to be the non-wearing state, the non-wearing counter is incremented in step F103. On the other hand, when the state is determined to be the wearing state, the non-wearing counter is cleared in step F104.

The wearing state detection unit 24 checks whether a value of the non-wearing counter exceeds a predetermined threshold value in step F105.

As can be seen from the above-described process of steps F103 and F104, the non-wearing counter is the counter indicating a continuation time of the state determined to be "non-wearing" in step F102. When the state determined to be "non-wearing" exceeds a predetermined time serving as the threshold value, the wearing state detection unit 24 sets "non-wearing" as the final result and notifies the control unit 15 of the non-wearing state according to a detection signal Sdet in step F106.

On the other hand, if the value of the non-wearing counter does not reach the predetermined threshold value, "wearing" is set as the final result and the control unit 15 is notified of the wearing state in the detection signal Sdet in step F107.

The wearing state detection unit 24 increments the cycle counter in step F108.

Accordingly, it is checked whether a value of the cycle counter has exceeded a counter value as one cycle determined in advance. If the value of the cycle counter has not exceeded the counter value as the one cycle determined in advance, the process of step F102 is directly continued. When the value of the cycle counter reaches the one cycle, the wearing state detection unit 24 clears the cycle counter in step F110, clears the non-wearing counter in step F111, and returns to step F102.

The wearing state detection unit 24, for example, executes the above process continuously while the power supply is turned on. Thereby, when the non-wearing determination state has been continued for a predetermined time or more in a cycle unit measured in the cycle counter, the wearing state detection unit 24 notifies the control unit 15 of the determination result serving as "non-wearing."

On the other hand, the control unit 15, for example, performs the process of FIG. 10B.

For example, in an interrupt process or the like for every predetermined time, the detection signal Sdet is checked in step F201. When the detection signal Sdet is a value indicating "non-wearing," the control unit 15 moves the process from step F202 to step F203 and performs power supply OFF control for the power supply unit 16.

According to the above-described process, the wearing state detection unit 24 detects the non-wearing state, so that the power supply of the headphones 1 is turned off. For example, the power supply is automatically turned off when the user takes off the headphones 1, and unnecessary battery consumption is avoided.

As described above, the wearing state detection unit 24 is set to detect the non-wearing state with certainty by ultimately determining the state as "non-wearing" with continuity of the determination of the non-wearing state within a cycle unit. When the control unit 15 performs power supply OFF control according to non-wearing detection as described above, there is inconvenience in that the power supply is unexpectedly turned off when the state is erroneously determined to be the non-wearing state while the headphones are being used. In the process of FIG. 10A, it is practically appropriate to prevent erroneous detection of the non-wearing state by accurately detecting the non-wearing state.

Figure 11:
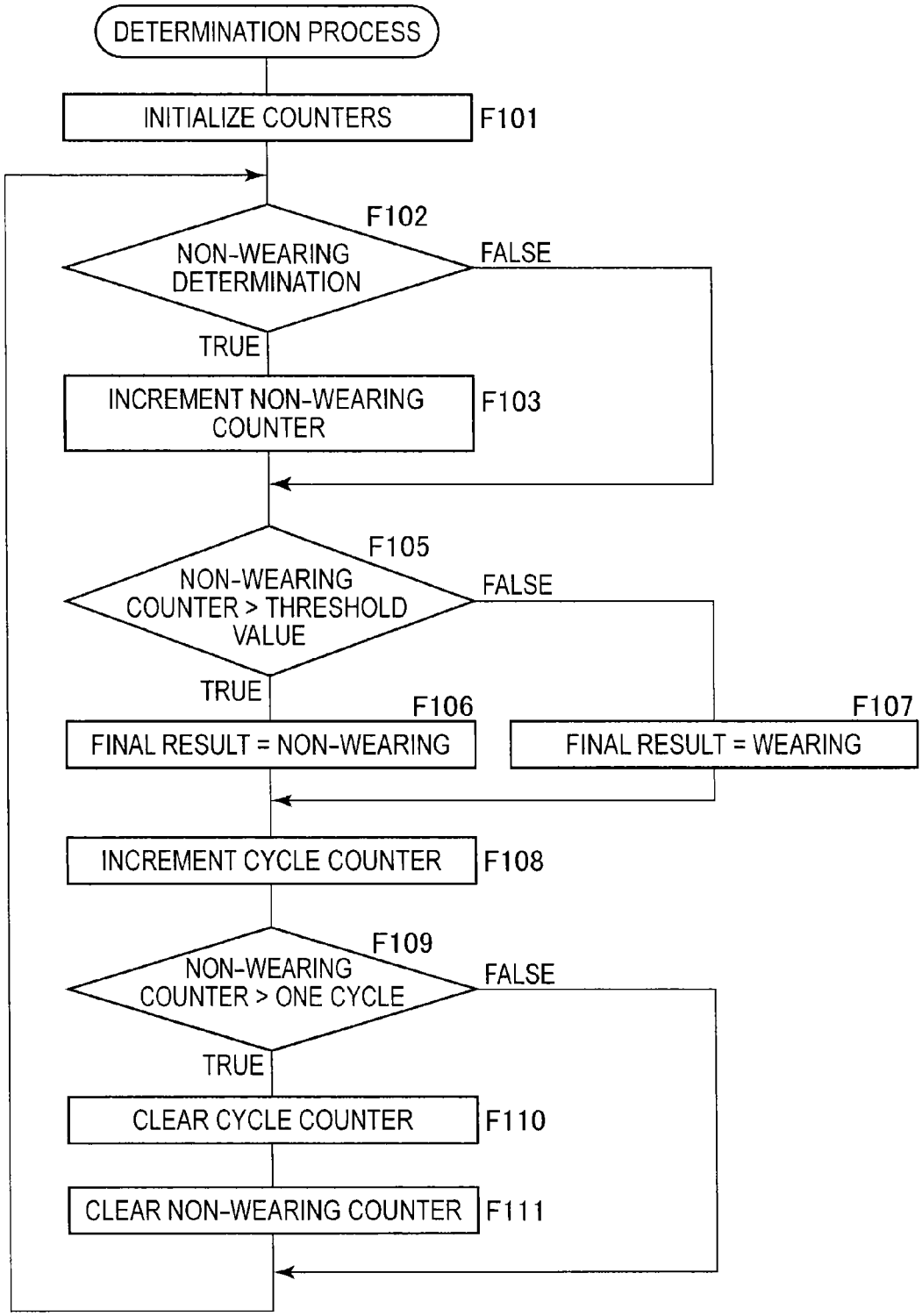
FIG. 11 is a flowchart of another wearing determination process of an embodiment.

Also, the wearing state detection unit 24 may be set to perform the process of FIG. 11 instead of the process of FIG. 10A.

The process of FIG. 11 is different from the process of FIG. 10A in that step F104 is not performed. That is, when the state is determined not to be non-wearing in step F102, the process proceeds to step F105 without clearing the non-wearing counter. The remaining process is substantially the same as in FIG. 10A.

In this case, because the non-wearing stare counter is not cleared even when the state is temporarily determined to be the wearing state in step F102, a value of the non-wearing counter to be compared to a threshold value in step F105 is not a continuation time of the non-wearing determination, and serves as an accumulation time (the number of non-wearing determinations) within a cycle unit.

That is, if a ratio at which the state is determined to be non-wearing within the cycle unit is high, the state is determined to be non-wearing in step F106 as the final result.

Even in this process, as in FIG. 10A, it is possible to improve the certainty of the non-wearing determination.

Although the first embodiment has been described above, wearing/non-wearing is detected using sound signals picked up by the outside microphone 4 and the inside microphone 5 in the headphones 1 of the embodiment.

By performing power supply OFF control when the non-wearing state has been detected, it is possible to prevent power supply OFF from being forgotten and prevent ineffective consumption of a battery. Thereby, it is possible to eliminate the inconvenience due to unintended battery consumption in the active headphones.

Furthermore, in the case of this embodiment, wearing/non-wearing can be detected even when a reproduction sound such as music is not output from the reproduction device 100. Accordingly, it is possible to appropriately detect the wearing state even in use for obtaining silence using the noise canceling system and perform power supply control corresponding thereto.

In addition, in the case of this embodiment, the inside microphone 5 necessary for wearing detection can be shared as a microphone mounted for the FB type noise canceling system. Thus, because only the outside microphone 4 is added as a constituent element, a component-related burden is small. In addition, the addition of a small-sized microphone as the outside microphone 4 rarely causes the restriction of a design or an increase in a headphone size or the like. The present disclosure is also suitable for an application to headphones (earphones) in an inner ear type, a canal type, and the like as well as sealed headphones.

In addition, the headphones of the embodiment of the present disclosure do not affect the wearing sensation of the user.

3. Second Embodiment

FF Type Noise Canceling System

The case in which the FF type noise canceling system is mounted will be described as the second embodiment.

Figure 2:
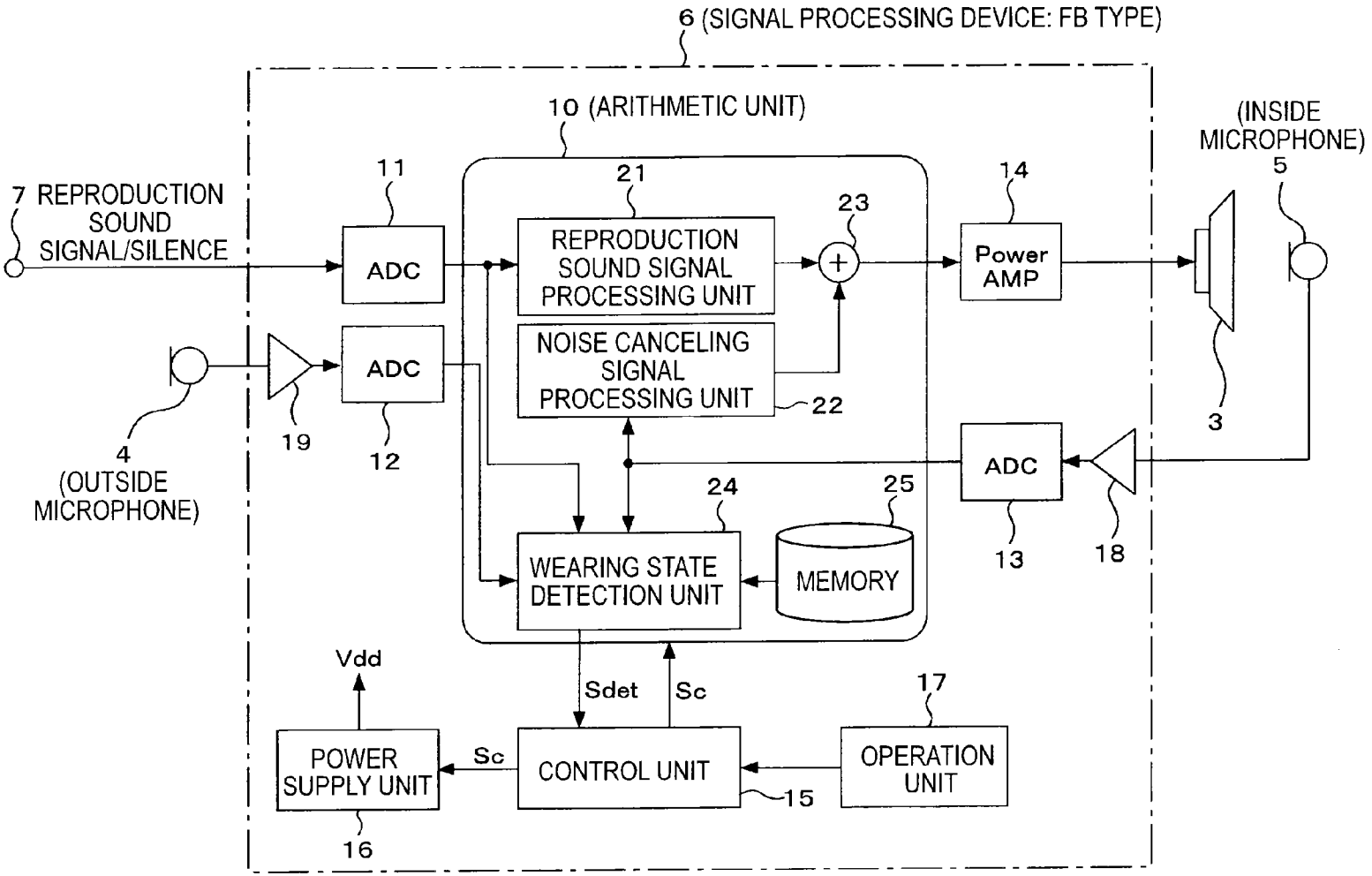
FIG. 2 is a block diagram of a signal processing device of headphones of a first embodiment.
Figure 12:
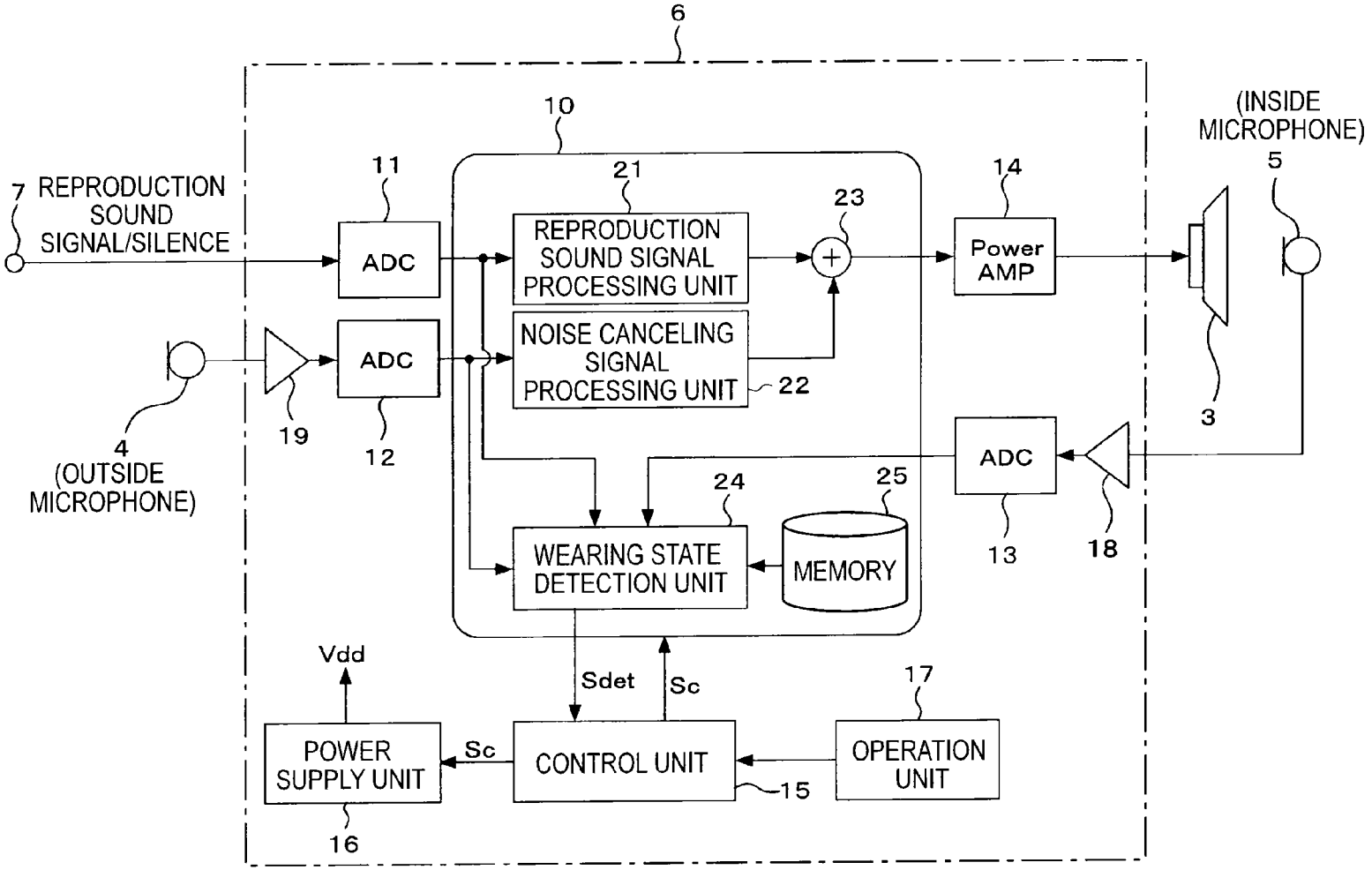
FIG. 12 is a block diagram of a signal processing device of headphones of a second embodiment.

FIG. 12 illustrates a configuration example of the headphones 1 equipped with the FF type noise canceling system in the second embodiment in a format similar to that of FIG. 2. The same parts as in FIG. 2 are assigned the same reference signs and description thereof is omitted.

FIG. 12 is different from FIG. 2 in that a sound signal picked up by the outside microphone 4 is supplied to a noise canceling signal processing unit 22 via a microphone amplifier 19 and an A/D converter 12. Other details are substantially the same as in FIG. 2.

The FF type noise canceling system basically generates a noise canceling signal by installing a microphone (outside microphone 4) for noise sound pickup outside a housing of headphones and performing an appropriate filtering process on noise picked up by the outside microphone 4. Acoustic reproduction on the generated noise canceling signal is performed by the driver unit 3 and noise is canceled at a position near the ears of a listener, that is, on the front surface of the diaphragm of the driver unit 3.

Noise picked up by the outside microphone 4 and noise within the headphone housing have different characteristics according to a difference between spatial positions of the two (including a difference between the inside and the outside of the headphone housing 2). Therefore, in the case of the FF scheme, the noise canceling signal processing unit 22 is set to generate a noise canceling signal in anticipation of a difference between spatial transfer functions of noise picked up by the outside microphone 4 and noise at a noise cancellation point (a listening point of the listener of the front surface of the driver unit).

The A/D converter 12 converts a sound signal picked up by the outside microphone 4 and amplified by the microphone amplifier 19 into a digital signal and supplies the digital signal to the wearing state detection unit 24. In addition, the A/D converter 13 converts a sound signal picked up by the inside microphone 5 and amplified by the microphone amplifier 18 into a digital signal and supplies the digital signal to the wearing state detection unit 24. Further, a reproduction sound signal converted by the A/D converter 11 into a digital signal is also supplied.

In addition, the wearing state detection unit 24 is configured to refer to a wearing state reference value and a non-wearing state reference value stored in the memory 25.

Figure 13:
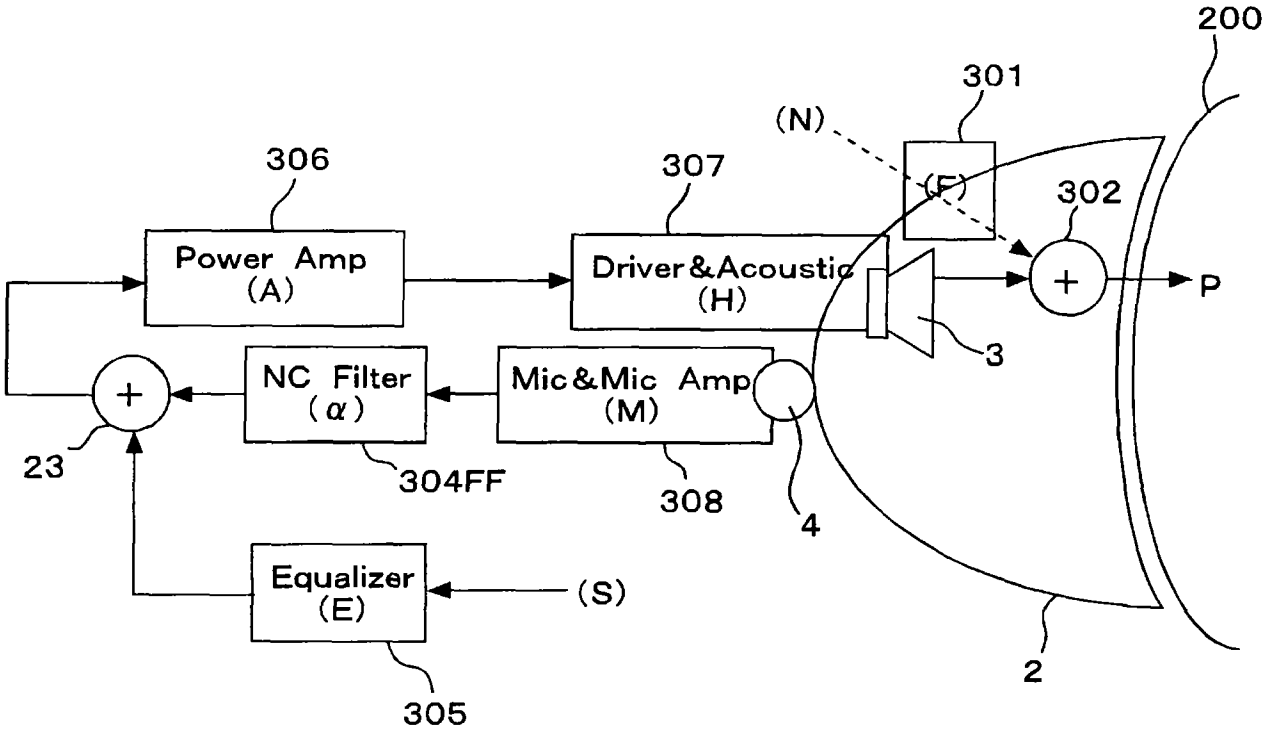
FIG. 13 is an explanatory diagram of a feed-forward (FF) type noise canceling system of the second embodiment.

FIG. 13 illustrates characteristics of parts of the FF type noise canceling system. FIG. 13 is different from the above-described FIG. 3 in that the outside microphone 4 is used for noise cancellation. Characteristics of the outside microphone 4 and the microphone amplifier 19 are shown as the microphone and microphone amplifier 308 and their sound signal characteristics are referred to as "M."

In addition, an NC filter 304FF exhibits a filtering process for noise canceling signal generation in the FF type of the noise canceling signal processing unit 22 in the arithmetic unit 10. A characteristic of the filtering process is referred to as "α."

Other details are similar to those of FIG. 3. The sound field 301 (F), the equalizer 305 (E), the power amplifier 306 (A), the driver and acoustic 307 (H), the sound source N of extraneous noise, and the reproduction sound signal S are shown.

Figure 14:
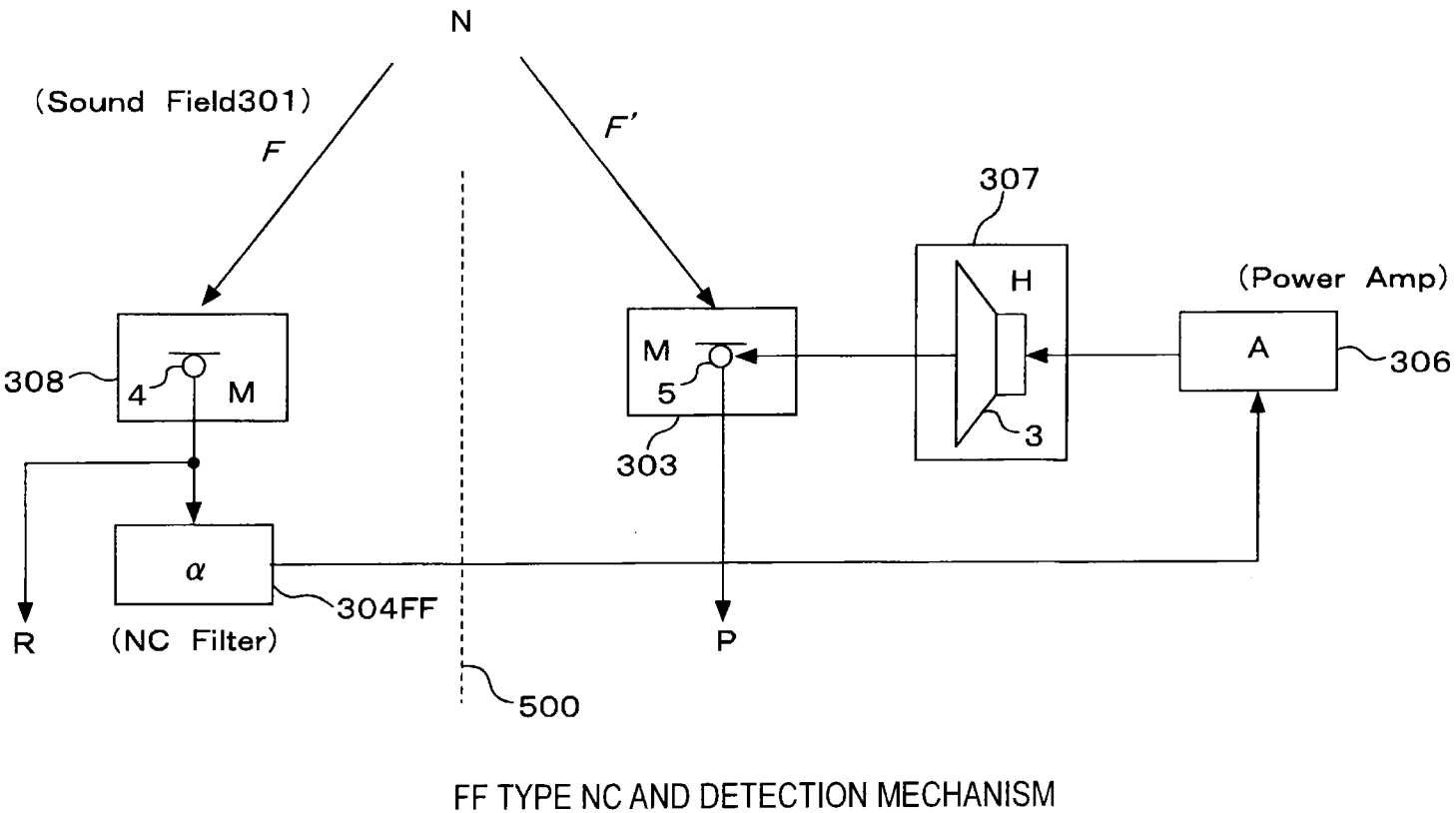
FIG. 14 is an explanatory diagram of characteristics of parts when there is no reproduction sound input of the second embodiment.

Under the assumption of the above characteristics, sound signals obtained by the inside microphone 5 and the outside microphone 4 when there is no reproduction sound signal S input from the reproduction device 100 will first be described with reference to FIG. 14. Although a format similar to that of FIG. 4 is shown, the sound signal obtained by the outside microphone 4 is input to the NC filter 304FF in the case of FIG. 14.

Equations (25) to (31) are referred to.

$$P_0 = F_0MN + F_0M\alpha AH_0MN = (1 + M\alpha AH_0)F_0MN \tag{25}$$

$$P_1 = F_1MN + F_0M\alpha AH_1MN = (F_1 + F_0M\alpha AH_1)MN \tag{26}$$

$$R = F_0MN \tag{27}$$

$$\frac{P_0}{R} = \frac{(1 + M\alpha AH_0)F_0MN}{F_0MN} = 1 + M\alpha AH_0 \tag{28}$$

$$\frac{P_1}{R} = \frac{(F_1 + F_0M\alpha AH_1)MN}{F_0MN} = \frac{F_1}{F_0} + M\alpha AH_1 \tag{29}$$

$$\frac{P_0}{R} - M\alpha AH_0 = 1 \tag{30}$$

$$\frac{P_1}{R} - M\alpha AH_1 = \frac{F_1}{F_0} \tag{31}$$

Sound pressure P (set to $P_0$) picked up by the inside microphone 5 when the non-wearing state is assumed is expressed in Equation (25).

Sound pressure P (set to $P_1$) picked up by the inside microphone 5 when the wearing state is assumed is expressed in Equation (26).

Sound pressure R picked up by the outside microphone 4 is expressed in Equation (27).

When a ratio is calculated as in the first embodiment, Equations (28) and (30) are obtained in the non-wearing state and Equations (29) and (31) are obtained in the wearing state.

Equation (30) represents a non-wearing state reference value, Equation (31) represents a wearing state reference value, and Equations (30) and (31) are equal to the above-described Equations (6) and (7).

When the headphones 1 are in operation, the following operation is performed. Equations (32) to (35) are referred to.

$$T_0 = f_0(P, R) = \frac{P}{R} - M\alpha AH_0 \tag{32}$$

$$T_1 = f_0(P, R) = \frac{P}{R} - M\alpha AH_1 \tag{33}$$

$$d_0 = |1 - T_0| \tag{34}$$

-continued $$d_1 = \left|\frac{F_1}{F_0} - T_1\right| \tag{35}$$

As in the first embodiment, when the headphones 1 are in operation, "$T_0$" and "$T_1$" of Equations (32) and (33) are calculated constantly from "P" and "R" picked up by the inside microphone 5 and the outside microphone 4.

In the case of the non-wearing state, $T_0$ of Equation (32) is equal to Equation (30) as long as the ideal condition is given. In the case of the wearing state, $T_1$ of Equation (33) is equal to Equation (31) as long as the ideal condition is given.

Consequently, Equations (32) and (33) are calculated, and Equations (34) and (35) are derived and compared to Equations (30) and (31).

A distance $d_0$ of Equation (34) represents a distance between the calculated value $T_0$ of Equation (32) and the non-wearing state reference value (=1). A distance $d_1$ of Equation (35) represents a distance between the calculated value $T_1$ of Equation (33) and the wearing state reference value (=$F_1$/N. Accordingly, the distances $d_0$ and $d_1$ are compared.

If $d_0<d_1$, the state is determined to be the non-wearing state. If $d_0 \geq d_1$, the state is determined to be the wearing state.

Wearing/non-wearing can be determined in the above-described concept.

Figure 15:
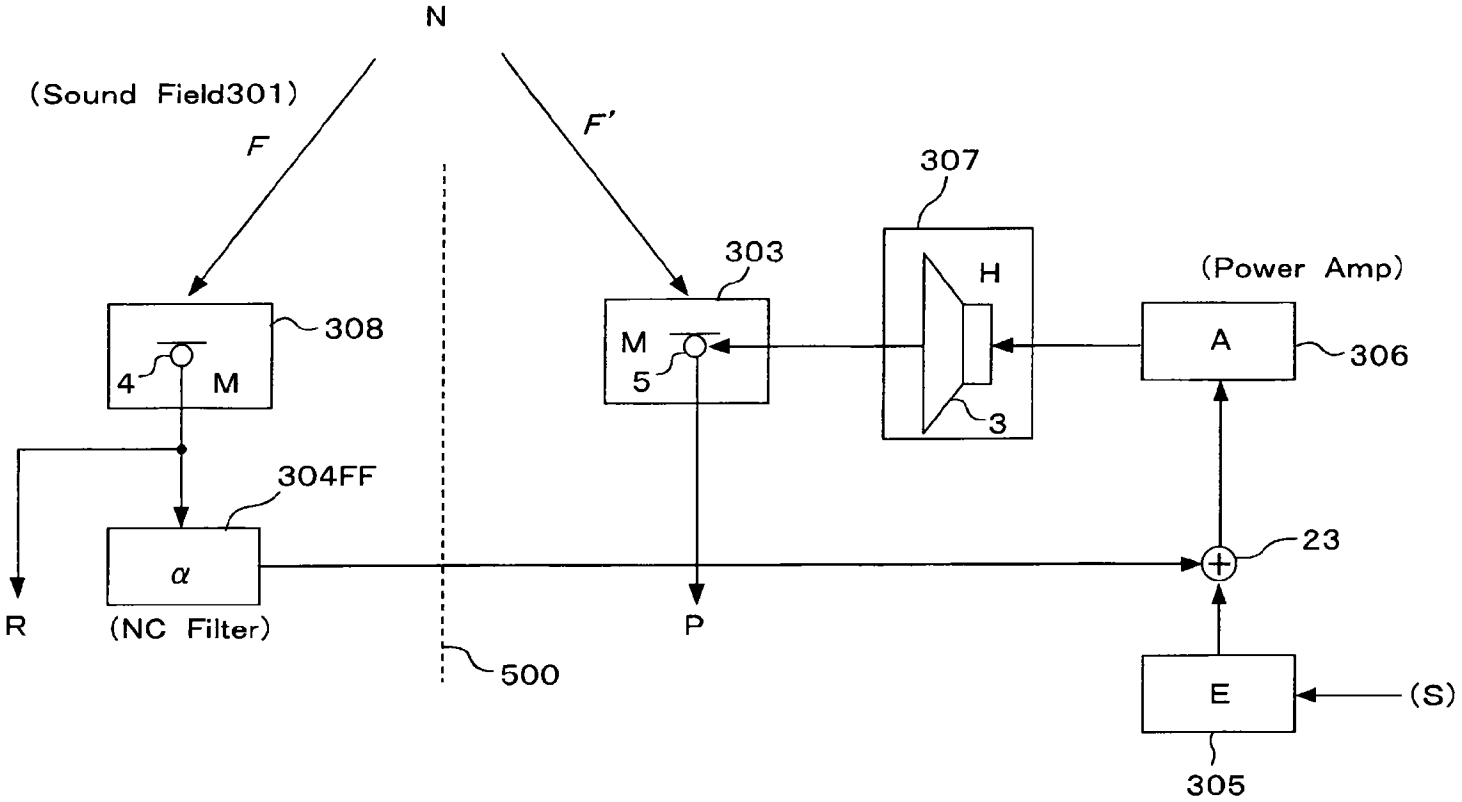
FIG. 15 is an explanatory diagram of characteristics of parts when there is a reproduction sound input of the second embodiment.

FIG. 15 corresponds to the case in which an input of the reproduction sound signal S has been considered.

That is, a signal processing characteristic "E" in the equalizer 305 is given for the reproduction sound signal S. The adder 23 adds the signal processing characteristic "E" to a noise canceling signal (an output of the NC filter 304FF).

Then, equations based on the concept similar to the above are as follows.

$$P_0 = F_0MN + F_0M\alpha AH_0MN + EAH_0MS \tag{36}$$

$$Q_0 = P_0 - EAH_0MS = (1 + \alpha AH_0M)F_0MN \tag{37}$$

$$P_1 = F_1MN + F_0M\,\alpha AH_1MN + EAH_1MS \tag{38}$$

$$Q_1 = P_1 - EAH_1MS = (F_1 + F_0\alpha AH_1M)MN \tag{39}$$

$$\frac{Q_0}{R} = \frac{(1 + \alpha AH_0M)F_0MN}{F_0MN} = 1 + \alpha AH_0M \tag{40}$$

$$\frac{Q_0}{R} - \alpha AH_0M = 1 \tag{41}$$

$$\frac{Q_1}{R} = \frac{(F_1 + F_0\alpha AH_1M)MN}{F_0MN} = \frac{F_1}{F_0} + \alpha AH_1M \tag{42}$$

$$\frac{Q_1}{R} - \alpha AH_1M = \frac{F_1}{F_0} \tag{43}$$

The equation of $P_0$ of Equation (36) is an equation of sound pressure picked up by the inside microphone 5 when the non-wearing state has been assumed. Equation (37) represents a sound pickup sound pressure characteristic "$Q_0$" of the inside microphone 5 in the non-wearing state by modifying Equation (36).

The equation of $P_1$ of Equation (38) is an equation of sound pressure picked up by the inside microphone 5 when the wearing state has been assumed. Equation (39) represents a sound pickup sound pressure characteristic "$Q_1$" of the inside microphone 5 in the wearing state by modifying Equation (38).

Sound pressure R picked up by the outside microphone 4 becomes the above-described Equation (27).

When a ratio is calculated as described above, Equations (40) and (41) are obtained in the non-wearing state and Equations (42) and (43) are obtained in the wearing state. Equations (41) and (43) are equivalent to the above-described Equations (6) and (7).

Accordingly, it is possible to perform wearing detection when the headphones 1 are used or the like using the non-wearing state reference value serving as Equation (41) and the wearing state reference value serving as Equation (43).

When the headphones 1 are in operation, the following operation is performed. Equations (44) to (47) are referred to.

$$T_0 = \frac{Q}{R} - \alpha AH_0M = \frac{P_0 - EAH_0MS}{R} - \alpha AH_0M \tag{44}$$

$$T_1 = \frac{Q}{R} - \alpha AH_1M = \frac{P_1 - EAH_1MS}{R} - \alpha AH_1M \tag{45}$$

$$d_0 = |1 - T_0| \tag{46}$$

$$d_1 = \left|\frac{F_1}{F_0} - T_1\right| \tag{47}$$

When the headphones 1 are in operation, "$T_0$" and "$T_1$" of Equations (44) and (45) are calculated constantly from the signal "P" picked up by the inside microphone 5 and the signal "R" picked up by the outside microphone 4.

The calculated value $T_0$ of Equation (44) is a value of a signal comparison result between a sound signal obtained by the outside microphone 4 and a sound signal obtained by the inside microphone 5 when the non-wearing state has been assumed. When the state is actually the non-wearing state, the calculated value $T_0$ is equal to the non-wearing state reference value (=1) of Equation (41) as long as the ideal condition is given.

In addition, the calculated value $T_1$ of Equation (45) is a value of a signal comparison result between a sound signal obtained by the outside microphone 4 and a sound signal obtained by the inside microphone 5 when the wearing state has been assumed. When the state is actually the wearing state, the calculated value $T_1$ is equal to the wearing state reference value ($=F_1/F_0$) of Equation (43) as long as the ideal condition is given.

Distances $d_0$ and $d_1$ from ideal values as in Equations (46) and (47) are obtained for the calculated values "$T_0$" and "$T_1$" The distance $d_0$ represents a distance between the calculated value $T_0$ and the non-wearing state reference value (=1). The distance $d_1$ represents a distance between the calculated value $T_1$ and the wearing state reference value ($=F_1/F_0$).

Accordingly, the distances $d_0$ and $d_1$ are compared. If $d_0<d_1$, the state is determined to be the non-wearing state. If $d_0 \geq d_1$, the state is determined to be the wearing state.

As described above, wearing/non-wearing can be determined by determining the similarity (distance) with the non-wearing state reference value and the wearing state reference value for the signal comparison result between the sound signal obtained by the outside microphone 4 and the sound signal obtained by the inside microphone 5.

Even when the headphones 1 generate an acoustic output of a reproduction sound such as music as described above, the wearing state detection can be ultimately performed as in the case in which there is no reproduction sound.

In the actual headphones 1, it is only necessary to detect the wearing state in the concept described with reference to the above-described Equations (36) to (47). That is, the calculations of Equations (44) and (45) are set to be performed as a real-time process while the headphones operate. This is because Equations (44) and (45) are equivalent to Equations (32) and (33) when no reproduction sound signal S is input.

In addition, when the distances $d_0$ and $d_1$ obtained by Equations (46) and (47) are ultimately compared, $(d_0 \cdot {}_0)$ and $(d_1 \cdot k_1)$ may be compared using coefficients.

Even in the case of the headphones 1 adopting the above FF type noise canceling system, it is possible to perform wearing detection in the concept similar to that of the first embodiment.

It is only necessary for the specific operation to be similar to the operation described with reference to FIGS. 6 to 11 in the first embodiment.

Accordingly, an effect similar to that of the first embodiment is also obtained in the second embodiment. Also, in the case of the second embodiment, the outside microphone 4 necessary for wearing detection can be shared as a microphone mounted for the FF type noise canceling system.

4. Third Embodiment

(FF+FB) Type Noise Canceling System

Headphones 1 in which the (FF+FB) type noise canceling system (also referred to as a twin type) is mounted will be described as the third embodiment.

Figure 16:
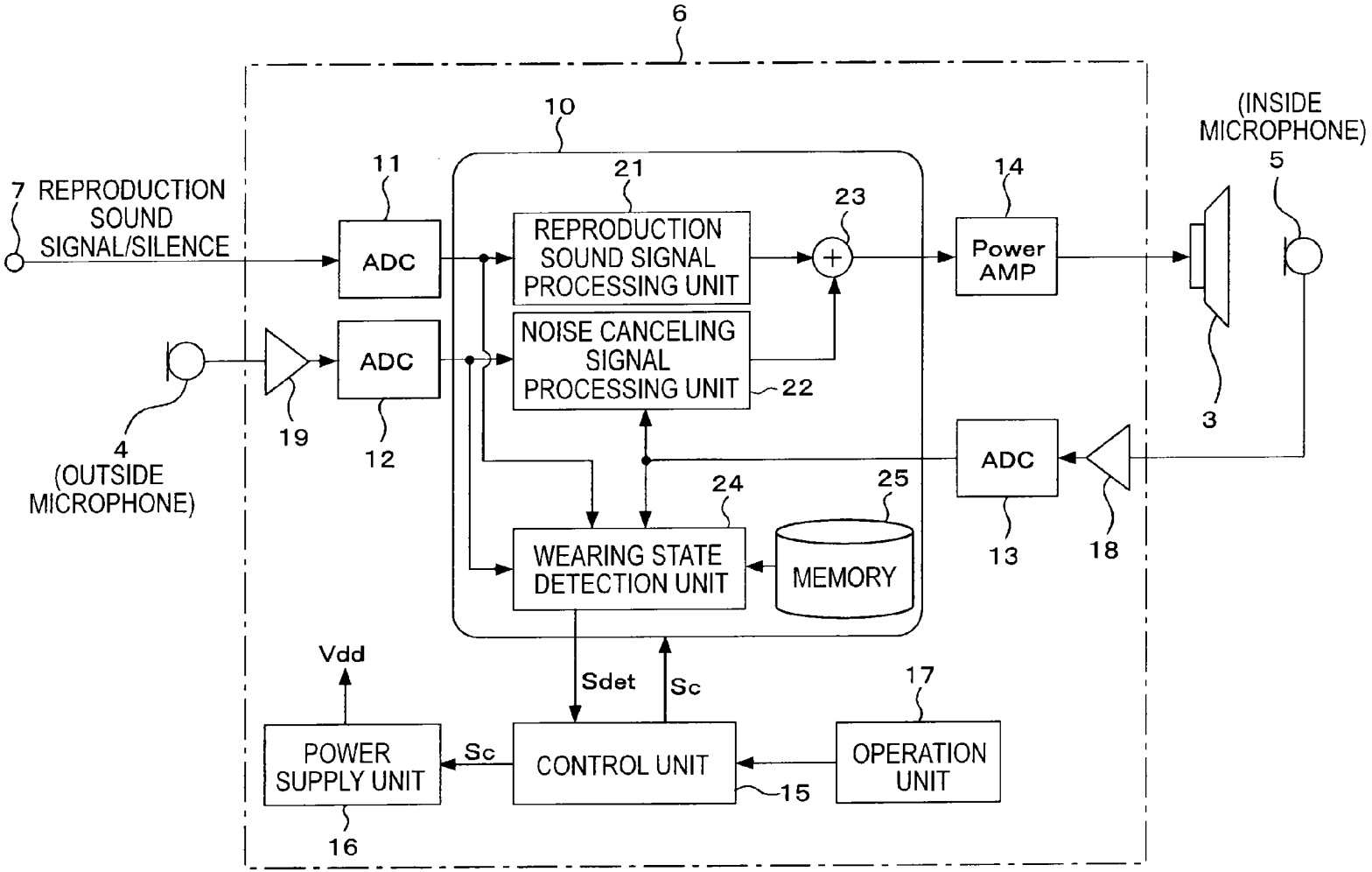
FIG. 16 is a block diagram of a signal processing device of headphones of a third embodiment.

FIG. 16 illustrates a configuration example of the headphones 1 equipped with the twin type noise canceling system in the third embodiment in a format similar to those of FIGS. 2 and 12. The same parts as in FIGS. 2 and 12 are assigned the same reference signs and description thereof is omitted.

In FIG. 16, a sound signal picked up by the outside microphone 4 is supplied to the noise canceling signal processing unit 22 via the microphone amplifier 19 and the A/D converter 12. Further, a sound signal picked up by the inside microphone 5 is supplied to the noise canceling signal processing unit 22 via the microphone amplifier 18 and the A/D converter 13.

In the noise canceling signal processing unit 22, the above-described FB type digital filtering process ($-\beta$) and the FF type digital filtering process ($\alpha$) are performed, and a noise canceling signal is generated by synthesizing outputs of the filtering processes.

Other details are substantially the same as in the above-described embodiments.

As in the first and second embodiments, a sound pickup sound signal of the outside microphone 4, a sound pickup sound signal of the inside microphone 5, and a reproduction sound signal are supplied to the wearing state detection unit 24.

Figure 17:
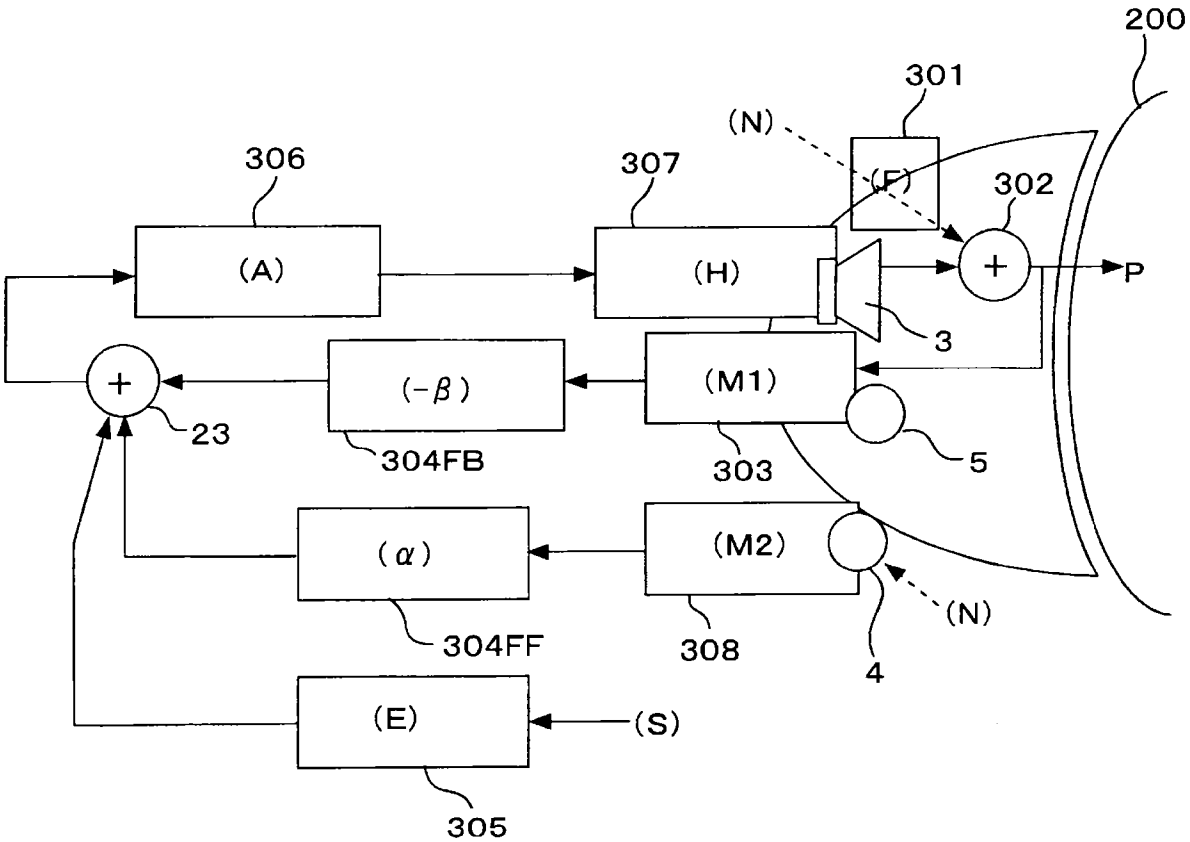
FIG. 17 is an explanatory diagram of an (FF+FB) type noise canceling system of the third embodiment.

FIG. 17 illustrates characteristics of parts of the twin type noise canceling system.

Both the outside microphone 4 and the inside microphone 5 are used for noise canceling.

Characteristics of the inside microphone 5 and the microphone amplifier 18 are shown as the microphone and microphone amplifier 303 and their sound signal characteristics are referred to as "M1."

Characteristics of the outside microphone 4 and the microphone amplifier 19 are shown as the microphone and microphone amplifier 308 and their sound signal characteristics are referred to as "M2."

In addition, the NC filter 304FB exhibits a filtering process in the FB type of the noise canceling signal processing unit 22, and its filtering characteristic is referred to as "$-\beta$."

The NC filter 304FF exhibits a filtering process in the FF type of the noise canceling signal processing unit 22, and its filtering characteristic is referred to as "α".

Other details are similar to those of FIGS. 3 and 13. The sound field 301 (F), the equalizer 305 (E), the power amplifier 306 (A), the driver and acoustic 307 (H), the sound source N of extraneous noise, and the reproduction sound signal S are shown.

Figure 18:
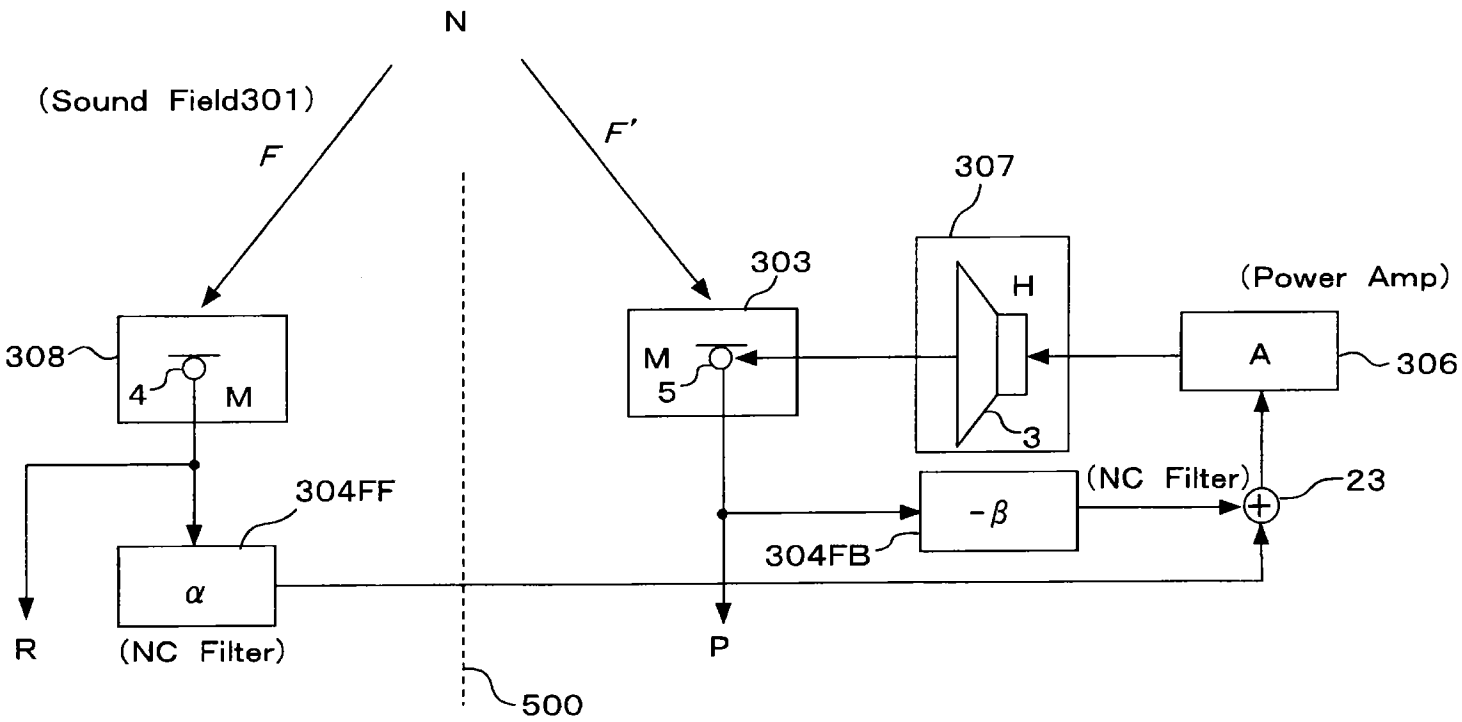
FIG. 18 is an explanatory diagram of characteristics of parts when there is no reproduction sound input of the third embodiment.

Under the assumption of the above characteristics, sound signals obtained by the inside microphone 5 and the outside microphone 4 when there is no reproduction sound signal S input from the reproduction device 100 will first be described with reference to FIG. 18. A format similar to those of FIGS. 4 and 14 is shown. However, in the case of FIG. 18, the sound signal obtained by the outside microphone 4 is input to the NC filter 304FF, and the sound signal obtained by the inside microphone 5 is input to the NC filter 304FB. Accordingly, outputs of the NC filters 304FF and 304FB are synthesized in the adder 23 and supplied to the power amplifier 306.

Also, characteristics of the microphone and microphone amplifier 303 and the microphone and microphone amplifier 308 are referred to as M (M1=M2).

Equations (48) to (56) are referred to.

$$R = F_0MN \tag{48}$$

$$P_0 = F_0MN + F_0M\alpha AH_0MN - P_0\beta AH_0M \tag{49}$$

$$Q_0 = (1 + \beta AH_0M)P_0 = (1 + \alpha AH_0M)F_0MN \tag{50}$$

$$\frac{Q_0}{R} = \frac{(1 + \alpha AH_0M)F_0MN}{F_0MN} = 1 + \alpha AH_0M \tag{51}$$

$$\frac{Q_0}{R} - \alpha AH_0M = 1 \tag{52}$$

$$P_1 = F_1MN + \alpha F_0MAH_1MN - \beta AH_1MP_1 \tag{53}$$

$$Q_1 = (1 + \beta AH_1M)P_1 = MN(F_1 + \alpha F_0MAH_1) \tag{54}$$

$$\frac{Q_1}{R} = \frac{MN(F_1 + \alpha F_0MAH_1)}{F_0MN} = \frac{F_1}{F_0} + \alpha F_0MAH_1 \tag{55}$$

$$\frac{Q_1}{R} - \alpha F_0MAH_1 = \frac{F_1}{F_0} \tag{56}$$

Sound pressure R picked up by the outside microphone 4 is expressed in Equation (48).

Sound pressure P (set to $P_0$) picked up by the inside microphone 5 when the non-wearing state is assumed is expressed in Equation (49).

$Q_0$ of Equation (50) is obtained by modifying Equation (49).

When a ratio is calculated as in the first embodiment, Equations (51) and (52) are obtained in the non-wearing state.

Equation (52) becomes the non-wearing state reference value, and is equal to the above-described Equation (6).

Sound pressure P (set to $P_1$) picked up by the inside microphone 5 when the wearing state is assumed is expressed in Equation (53).

$Q_1$ of Equation (54) is obtained by modifying Equation (53).

When a ratio is calculated as in the first embodiment, Equations (55) and (56) are obtained in the wearing state.

Equation (56) becomes the wearing state reference value, and is equal to the above-described Equation (7).

When the headphones 1 are in operation, the following operation is performed. Equations (57) to (60) are referred to.

$$T_0 = f_0(P, R) = (1 + \beta AH_0M)\frac{P}{R} \tag{57}$$

$$T_1 = f_1(P, R) = (1 + \beta AH_1M)\frac{P}{R} \tag{58}$$

$$d_0 = |1 - T_0| \tag{59}$$

$$d_1 = \left|\frac{F_1}{F_0} - T_1\right| \tag{60}$$

As in the above-described embodiment, when the headphones 1 are in operation, "$T_0$" and "$T_1$" of Equations (57) and (58) are calculated constantly from "P" and "R" picked up by the inside microphone 5 and the outside microphone 4.

$T_0$ of Equation (57) is equal to Equation (52) as long as the ideal condition is given in the case of the non-wearing state. $T_1$ of Equation (58) is equal to Equation (56) as long as the ideal condition is given in the case of the wearing state.

Consequently, Equations (57) and (58) are calculated, and Equations (59) and (60) are derived and compared to Equations (52) and (56).

A distance $d_0$ of Equation (59) represents a distance between the calculated value $T_0$ of Equation (57) and the non-wearing state reference value (=1). A distance $d_1$ of Equation (60) represents a distance between the calculated value $T_1$ of Equation (58) and the wearing state reference value ($=F_1/F_0$). Accordingly, the distances $d_0$ and $d_1$ are compared.

If $d_0<d_1$, the state is determined to be the non-wearing state. If $d_0 \geq d_1$, the state is determined to be the wearing state.

Wearing/non-wearing can be determined in the above-described concept.

Figure 19:
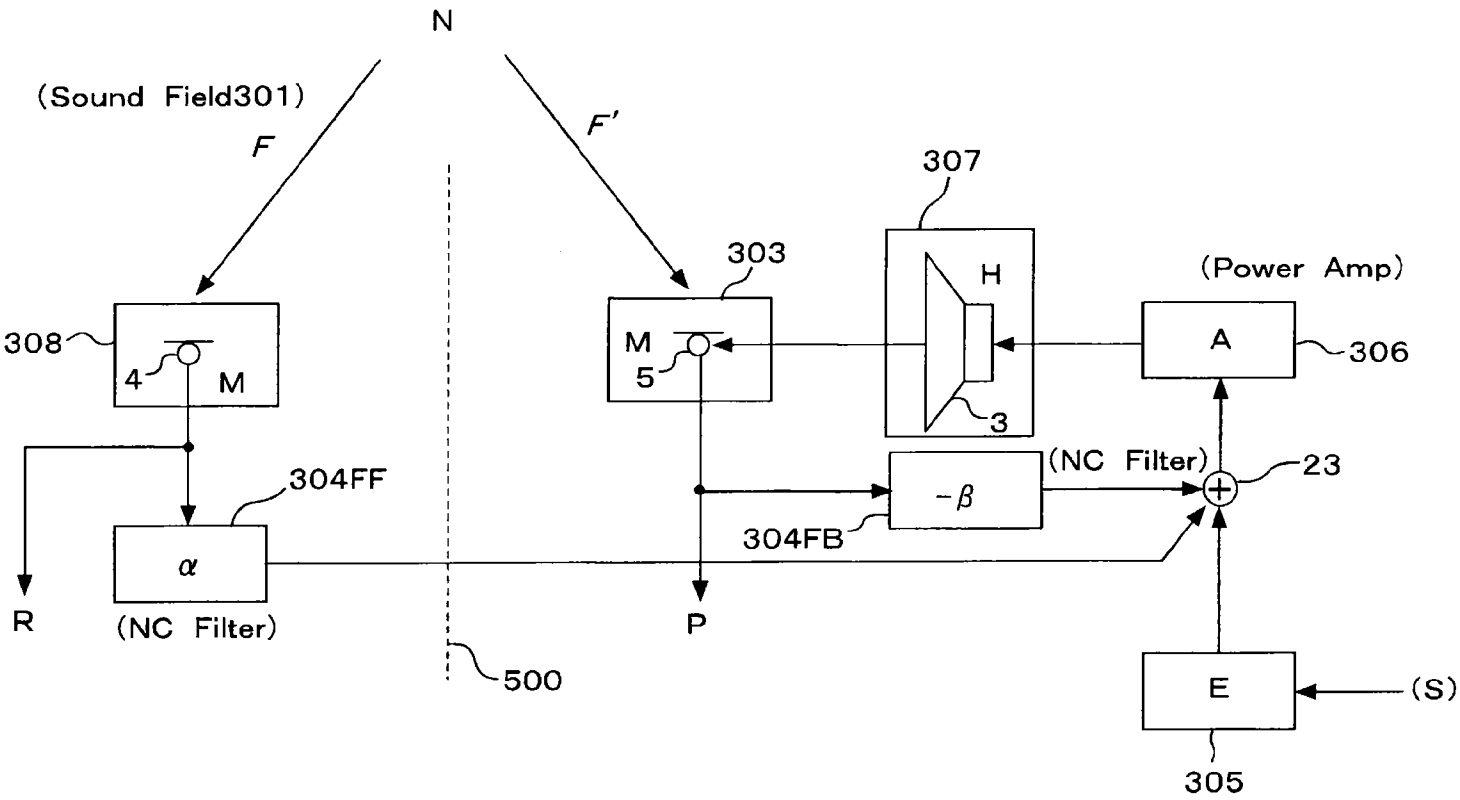
FIG. 19 is an explanatory diagram of characteristics of parts when there is a reproduction sound input of the third embodiment.

FIG. 19 corresponds to the case in which an input of the reproduction sound signal S has been considered.

A signal processing characteristic "E" in the equalizer 305 is given for the reproduction sound signal S. The adder 23 adds the signal processing characteristic "E" to a noise canceling signal (outputs of NC filters 304FF and 304FR).

Then, equations based on the concept similar to the above are as follows.

$$R = F_0MN \tag{61}$$

$$P_0 = F_0MN - \beta AH_0MP_0 + F_0M\alpha AH_0MN + EAH_0MS \tag{62}$$

$$Q_0 = (1 + \beta AH_0M)P_0 - EAH_0MS = F_0MN(1 + \alpha AH_0M) \tag{63}$$

$$\frac{Q_0}{R} = \frac{F_0MN(1 + \alpha AH_0M)}{F_0MN} = 1 + \alpha AH_0M \tag{64}$$

$$\frac{Q_0}{R} - \alpha AH_0M = 1 \tag{65}$$

$$P_1 = F_1MN - \beta AH_1MP_1 + F_0M\alpha AH_1MN + EAH_1MS \tag{66}$$

$$Q_1 = (1 + \beta AH_1M)P_1 - EAH_1MS = MN(F_1 + F_0\alpha AH_1M) \tag{67}$$

$$\frac{Q_1}{R} = \frac{MN(F_1 + F_0\alpha AH_1M)}{F_0MN} = \frac{F_1}{F_0} + \alpha AH_1M \tag{68}$$

$$\frac{Q_1}{R} - \alpha AH_1M = \frac{F_1}{F_0} \tag{69}$$

Sound pressure R picked up by the outside microphone 4 is expressed in Equation (61).

Sound pressure P (set to $P_0$) picked up by the inside microphone 5 when the non-wearing state is assumed is expressed in Equation (62). $Q_0$ of Equation (63) is obtained by modifying Equation (62).

When a ratio between sound pressures obtained by the inside microphone 5 and the outside microphone 4 is calculated, Equations (64) and (65) are obtained in the non-wearing state.

Equation (65) becomes the non-wearing state reference value, and is equal to the above-described Equation (6).

Sound pressure P (set to $P_1$) picked up by the inside microphone 5 when the wearing state is assumed is expressed in Equation (66). $Q_1$ of Equation (67) is obtained by modifying Equation (66).

When a ratio between sound pressures obtained by the inside microphone 5 and the outside microphone 4 is calculated, Equations (68) and (69) are obtained in the wearing state.

Equation (69) becomes the wearing state reference value, and is equivalent to the above-described Equation (7).

When the headphones 1 are in operation, the following operation is performed. Equations (70) to (73) are referred to.

$$T_0 = f_0(P, R, S) = (1 + \beta AH_0M)\frac{P}{R} - \frac{EAH_0MS}{R} \tag{70}$$

$$T_1 = f_1(P, R, S) = (1 + \beta AH_1M)\frac{P}{R} - \frac{EAH_1MS}{R} \tag{71}$$

$$d_0 = |1 - T_0| \tag{72}$$

$$d_1 = \left|\frac{F_1}{F_0} - T_1\right| \tag{73}$$

When the headphones 1 are in operation, "$T_0$" and "$T_1$" of Equations (70) and (71) are calculated constantly from the signal "P" picked up by the inside microphone 5 and the signal "R" picked up by the outside microphone 4.

The calculated value $T_0$ of Equation (70) is a value of a signal comparison result between a sound signal obtained by the outside microphone 4 and a sound signal obtained by the inside microphone 5 when the non-wearing state has been assumed. When the state is actually the non-wearing state, the calculated value $T_0$ is equal to the non-wearing state reference value (=1) of Equation (65) as long as the ideal condition is given.

In addition, the calculated value $T_1$ of Equation (71) is a value of a signal comparison result between a sound signal obtained by the outside microphone 4 and a sound signal obtained by the inside microphone 5 when the wearing state has been assumed. When the state is actually the wearing state, the calculated value $T_1$ is equal to the wearing state reference value ($=F_1/F_0$) of Equation (69) as long as the ideal condition is given.

Distances $d_0$ and $d_1$ from ideal values as in Equations (72) and (73) are obtained for the calculated values "$T_0$" and "$T_1$" The distance $d_0$ represents a distance between the calculated value $T_0$ and the non-wearing state reference value (=1). The distance $d_1$ represents a distance between the calculated value $T_1$ and the wearing state reference value ($=F_1/F_0$).

Accordingly, the distances $d_0$ and $d_1$ are compared. If $d_0<d_1$, the state is determined to be the non-wearing state. If $d_0 \geq d_1$, the state is determined to be the wearing state.

As described above, wearing/non-wearing can be determined by determining the similarity (distance) with the non-wearing state reference value and the wearing state reference value for the signal comparison result between the sound signal obtained by the outside microphone 4 and the sound signal obtained by the inside microphone 5.

Even when the headphones 1 generate an acoustic output of a reproduction sound such as music as described above, the wearing state detection can be ultimately performed as in the case in which there is no reproduction sound.

In the actual headphones 1, it is only necessary to detect the wearing state in the concept described with reference to the above-described Equations (61) to (73). That is, calculations of Equations (70) and (71) are set to be performed as a real-time process while the headphones operate. This is because Equations (70) and (71) are equal to Equations (57) and (58) when no reproduction sound signal S is input.

In addition, when the distances $d_0$ and $d_1$ obtained by Equations (72) and (73) are ultimately compared, ($d_0 \cdot k_0$) and ($d_1 \cdot k_1$) may be compared using coefficients.

In the case of the headphones 1 adopting the above twin type noise canceling system, it is possible to perform wearing detection in the concept similar to that of the above-described embodiment.

It is only necessary for the specific operation to be similar to the operation described with reference to FIGS. 6 to 11 in the first embodiment.

Accordingly, an effect similar to that of the first embodiment is also obtained in the third embodiment.

In addition, it is not necessary to include a new microphone for wearing detection in the case of the third embodiment in which the twin type noise canceling system is adopted. This is because the inside microphone 5 and the outside microphone 4 mounted for a noise cancellation process can also be directly used as microphones for the wearing detection.

5. Fourth Embodiment

Non-Mounting of Noise Canceling System

The above-described wearing detection technique can be applied to devices other than the noise canceling headphones. It is possible to detect the wearing state more easily than in the noise canceling headphones by mounting the inside microphone 5 and the outside microphone 4 on normal active headphones. An example of headphones 1 not equipped with the noise canceling system will be described as the fourth embodiment.

Figure 20:
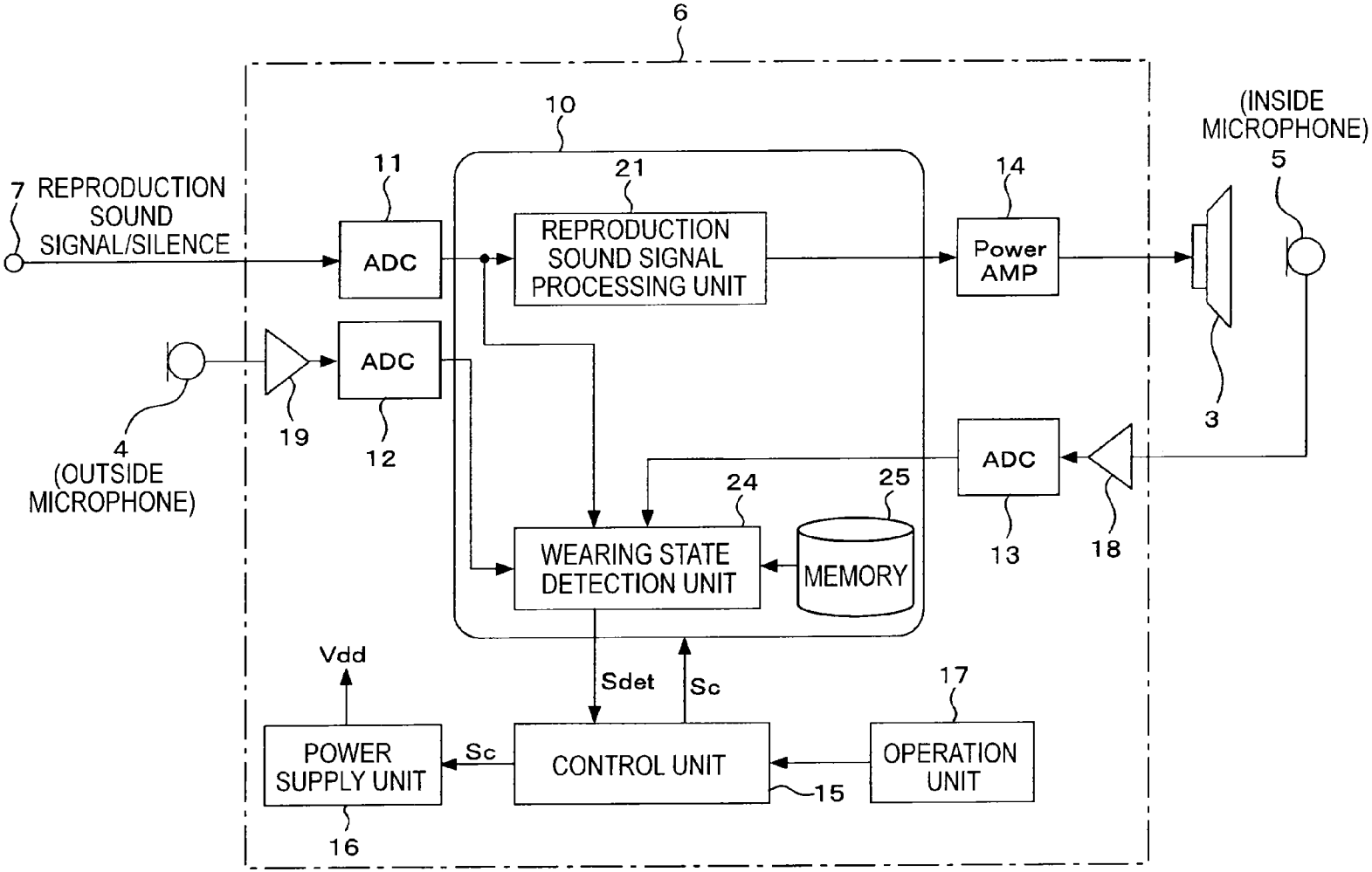
FIG. 20 is a block diagram of a signal processing device of headphones of a fourth embodiment.
Figure 21:
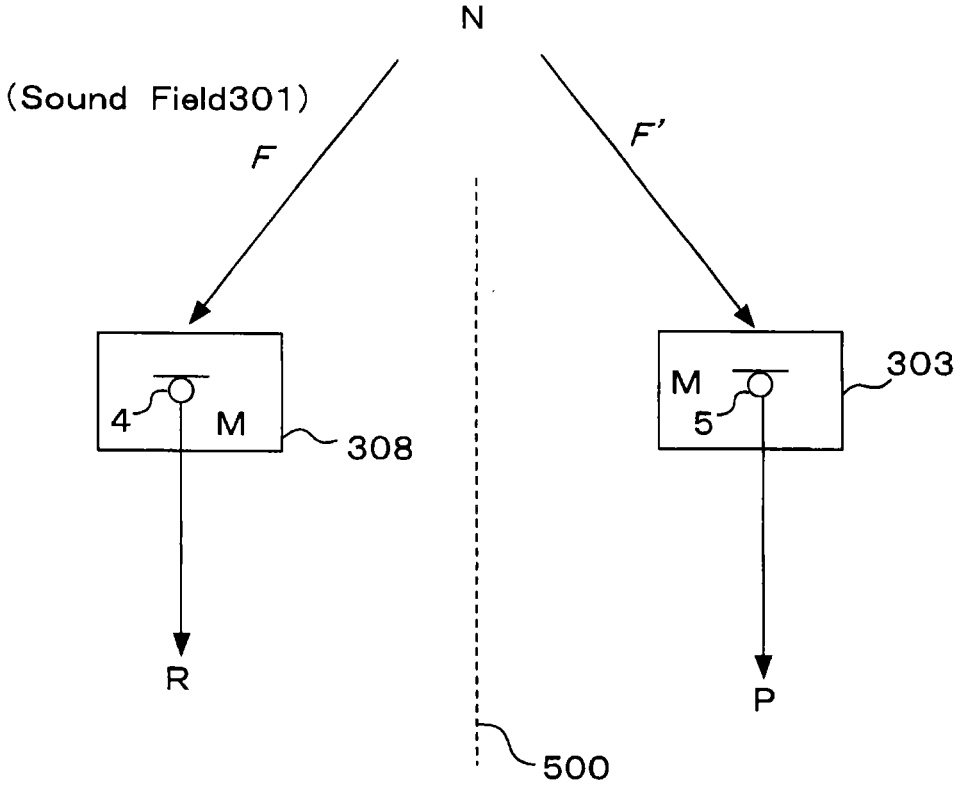
FIG. 21 is an explanatory diagram of characteristics of parts when there is no reproduction sound input of the fourth embodiment.

FIG. 20 illustrates a configuration example of the headphones 1 in the fourth embodiment in a format similar to those of FIGS. 2, 12, and 16. The same parts as in FIGS. 2, 12, and 16 are assigned the same reference signs and description thereof is omitted.

Because no noise canceling system is mounted in FIG. 20, sound pickup sound signals of the outside microphone 4 and the inside microphone 5 are used only for wearing detection.

A sound signal picked up by the outside microphone 4 is supplied to the wearing state detection unit 24 via the microphone amplifier 19 and the A/D converter 12, and a sound signal picked up by the inside microphone 5 is supplied to the wearing state detection unit 24 via the microphone amplifier 18 and the A/D converter 13. In addition, the reproduction sound signal is also supplied to the wearing state detection unit 24 via the A/D converter 11.

Other details are substantially the same as in the above-described embodiments.

First, sound signals obtained by the inside microphone 5 and the outside microphone 4 when no reproduction sound signal S is input from the reproduction device 100 will be described with reference to FIG. 18.

As in the above-described embodiment, characteristics of the sound source N of the extraneous noise and the sound field 301 (acoustic paths F and F') are referred to as $F_0$ and $F_1$, and characteristics of the microphone and microphone amplifier 303 and the microphone and microphone amplifier 308 are referred to as M.

The inside microphone 5 and the outside microphone 4 are used only for wearing detection. Because there is no reproduction sound input, sound pressures P and R become sound pressures only by the extraneous sound from the sound source N as illustrated in FIG. 18.

Equations (74) to (78) are referred to.

$$P_0 = F_0MN \tag{74}$$

$$P_1 = F_1MN \tag{75}$$

$$R = F_0MN \tag{76}$$

$$\frac{P_0}{R} = \frac{F_0MN}{F_0MN} = 1 \tag{77}$$

$$\frac{P_1}{R} = \frac{F_1MN}{F_0MN} = \frac{F_1}{F_0} \tag{78}$$

Sound pressure P (set to $P_0$) picked up by the inside microphone 5 when the non-wearing state is assumed is expressed in Equation (74).

Sound pressure P (set to $P_1$) picked up by the inside microphone 5 when the wearing state is assumed is expressed in Equation (75).

Sound pressure R picked up by the outside microphone 4 is expressed in Equation (76).

When a ratio between sound pressures obtained by the inside microphone 5 and the outside microphone 4 is calculated, Equation (77) is obtained in the non-wearing state. Equation (77) becomes the non-wearing state reference value, and is equivalent to the above-described Equation (6).

Equation (78) is obtained in the wearing state. Equation (78) becomes the wearing state reference value, and is equal to the above-described Equation (7).

When the headphones 1 are in operation, the following operation is performed. Equations (79) to (81) are referred to.

$$T = f(P, R) = \frac{P}{R} \tag{79}$$

$$d_0 = |1 - T| \tag{80}$$

$$d_1 = \left|\frac{F_1}{F_0} - T\right| \tag{81}$$

As in the above-described embodiments, when the headphones 1 are in operation, "T" of Equation (79) is calculated constantly from "P" and "R" picked up by the inside microphone 5 and the outside microphone 4. "T" is equal to Equation (77) as long as the ideal condition is given in the case of the non-wearing state, and is equivalent to Equation (78) as long as the ideal condition is given in the case of the wearing state.

Consequently, distances $d_0$ and $d_1$ are compared in Equations (80) and (81).

The distance $d_0$ of Equation (80) represents a distance between the calculated value "T" of Equation (79) and the non-wearing state reference value (=1). The distance $d_1$ of Equation (81) represents a distance between the calculated value T and the wearing state reference value ($=F_1/F_0$).

The distances $d_0$ and $d_1$ are compared. If $d_0<d_1$, the state is determined to be the non-wearing state. If $d_0 \geq d_1$, the state is determined to be the wearing state.

Wearing/non-wearing can be determined in the above-described concept.

Figure 22:
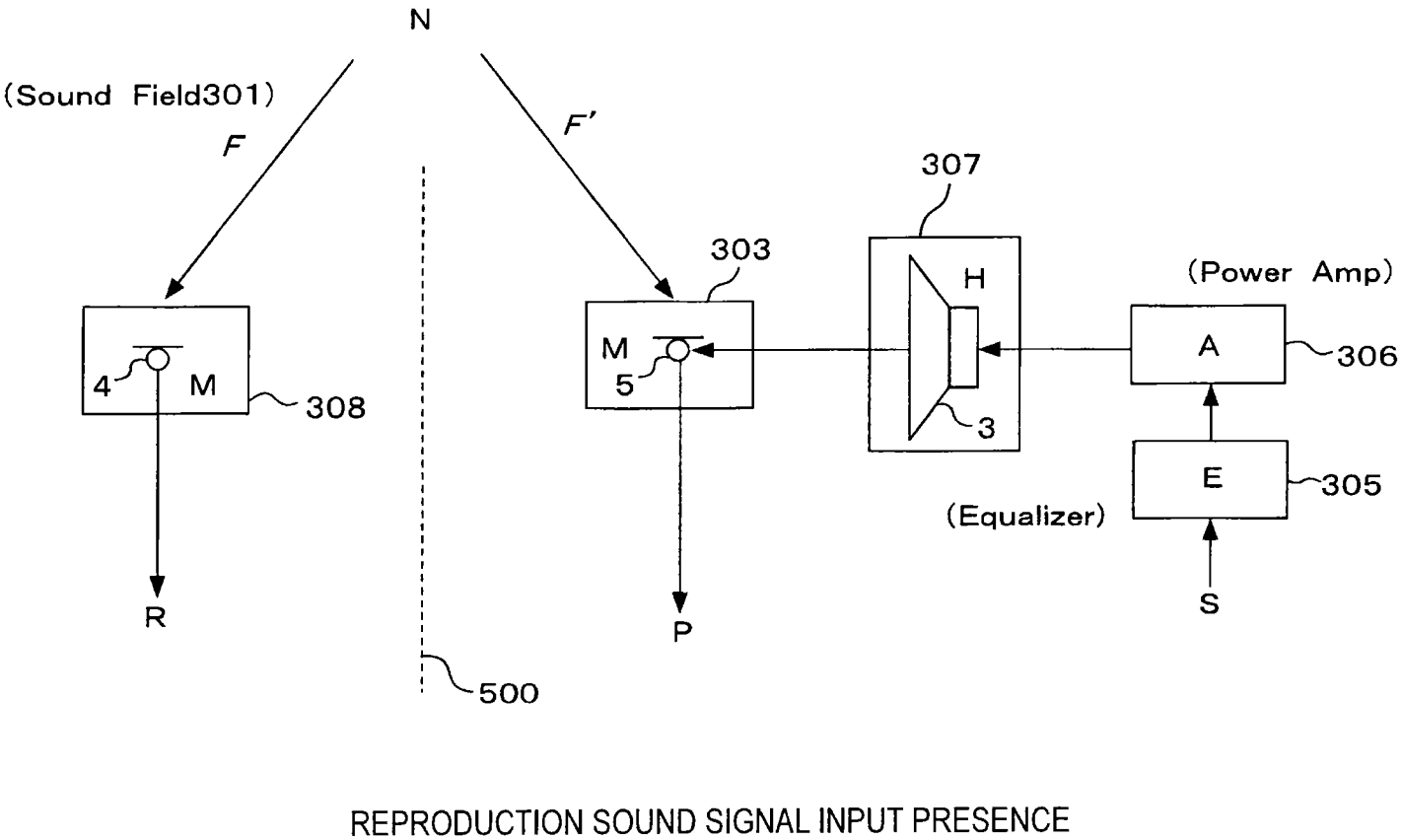
FIG. 22 is an explanatory diagram of characteristics of parts when there is a reproduction sound input of the fourth embodiment.

FIG. 22 corresponds to the case in which an input of the reproduction sound signal S has been considered.

A component of the reproduction sound signal S is added to the sound pressure P picked up by the inside microphone 5. That is, in the reproduction sound signal S at the sound pressure P, a component to which a signal processing characteristic "E" in the equalizer 305, a characteristic "A" of the power amplifier 306, a characteristic "H" of the driver and acoustic 307, and a characteristic "M" of the microphone and microphone amplifier 303 are given is included.

Then, equations based on the concept similar to the above are as follows.

$$P_0 = F_0MN + EAH_0MS \tag{82}$$

$$P_1 = F_1MN + EAH_1MS \tag{83}$$

$$R = F_0MN \tag{84}$$

$$Q_0 = P_0 - EAH_0MS = F_0MN \tag{85}$$

$$Q_1 = P_1 - EAH_1MS = F_1MN \tag{86}$$

$$\frac{Q_0}{R} = \frac{P_0 - EAH_0MS}{F_0MN} = \frac{F_0MN}{F_0MN} = 1 \tag{87}$$

$$\frac{Q_1}{R} = \frac{P_1 - EAH_1MS}{F_0MN} = \frac{F_1MN}{F_0MN} = \frac{F_1}{F_0} \tag{88}$$

Sound pressure P (set to $P_0$) picked up by the inside microphone 5 when the non-wearing state is assumed is expressed in Equation (82).

Sound pressure P (set to $P_1$) picked up by the inside microphone 5 when the wearing state is assumed is expressed in Equation (83).

Sound pressure R picked up by the outside microphone 4 is expressed in Equation (84).

$Q_0$ of Equation (85) is obtained by modifying Equation (82).

$Q_1$ of Equation (86) is obtained by modifying Equation (83).

When a ratio between sound pressures obtained by the inside microphone 5 and the outside microphone 4 is calculated, Equation (87) is obtained in the non-wearing state. Equation (87) becomes the non-wearing state reference value, and is equivalent to the above-described Equation (6).

When the wearing state is assumed, Equation (88) is obtained. Equation (88) becomes the wearing state reference value, and is equal to the above-described Equation (7).

When the headphones 1 are in operation, the following operation is performed. Equations (89) to (92) are referred to.

$$T_0 = f_0(P, R, S) = \frac{P - EAH_0MS}{R} \tag{89}$$

$$T_1 = f_1(P, R, S) = \frac{P - EAH_1MS}{R} \tag{90}$$

$$d_0 = |1 - T_0| \tag{91}$$

$$d_1 = \left|\frac{F_1}{F_0} - T_1\right| \tag{92}$$

When the headphones 1 are in operation, "$T_0$" and "$T_1$" of Equations (89) and (90) are calculated constantly from the signal "P" picked up by the inside microphone 5 and the signal "R" picked up by the outside microphone 4.

The calculated value $T_0$ of Equation (89) is a value of a signal comparison result between a sound signal obtained by the outside microphone 4 and a sound signal obtained by the inside microphone 5 when the non-wearing state has been assumed. When the state is actually the non-wearing state, the calculated value $T_0$ is equal to the non-wearing state reference value (=1) of Equation (87) as long as the ideal condition is given.

In addition, the calculated value $T_1$ of Equation (90) is a value of a signal comparison result between a sound signal obtained by the outside microphone 4 and a sound signal obtained by the inside microphone 5 when the wearing state has been assumed. When the state is actually the wearing state, the calculated value $T_1$ is equal to the wearing state reference value ($=F_1/F_0$) of Equation (88) as long as the ideal condition is given.

Distances $d_0$ and $d_1$ from ideal values as in Equations (91) and (92) for the calculated values "$T_0$" and "$T_1$" are obtained. The distance $d_0$ represents a distance between the calculated value $T_0$ and the non-wearing state reference value (=1). The distance $d_1$ represents a distance between the calculated value $T_1$ and the wearing state reference value ($=F_1/F_0$).

Accordingly, the distances $d_0$ and $d_1$ are compared. If $d_0<d_1$, the state is determined to be the non-wearing state. If $d_0 \geq d_1$, the state is determined to be the wearing state.

As described above, wearing/non-wearing can be determined by determining the similarity (distance) with the non-wearing state reference value and the wearing state reference value for the signal comparison result between the sound signal obtained by the outside microphone 4 and the sound signal obtained by the inside microphone 5.

Even when the headphones 1 generate an acoustic output of a reproduction sound such as music as described above, the wearing state detection can be ultimately performed as in the case in which there is no reproduction sound.

In the actual headphones 1, it is only necessary to detect the wearing state in the concept described with reference to the above-described Equations (82) to (92). That is, the calculations of Equations (89) and (90) as a real-time process are set to be performed while the headphones operate. When no reproduction sound signal S is input, Equations (89) and (90) are equivalent to Equation (79) ($T_0=T_1=T$).

In addition, when the distances $d_0$ and $d_1$ obtained by Equations (91) and (92) are ultimately compared, ($d_0 \cdot k_0$) and ($d_1 \cdot k_1$) may be compared using coefficients.

In the case of the headphones 1 not equipped with the noise canceling system as described above, it is possible to perform wearing detection in the concept similar to that of the above-described embodiment.

It is only necessary to perform the actual process as in the first embodiment.

6. Fifth Embodiment

Figure 7:
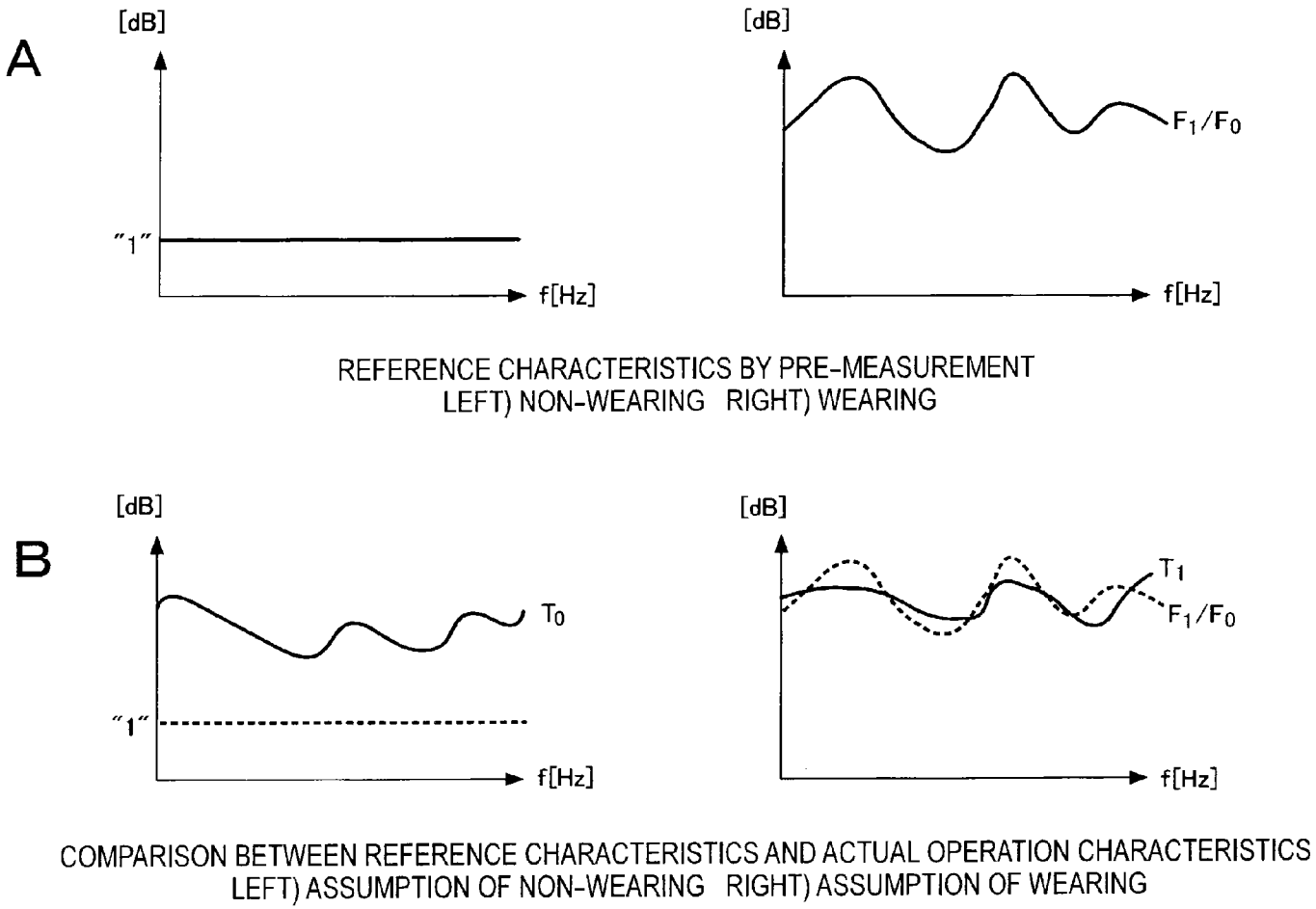
FIGS. 7A and 7B are explanatory diagrams of a comparison between measurement of the reference characteristics of the embodiment and actual operation characteristics.

Although a determination process example in which a comparison process is performed in a frequency domain has been described with reference to FIGS. 7 to 9 in the first embodiment as an actual process, a comparison process for a wearing determination may be performed by comparing amplitudes on a time axis.

An example of a process of performing the wearing determination in a time axis amplitude comparison will be described as the fifth embodiment.

Figure 23:
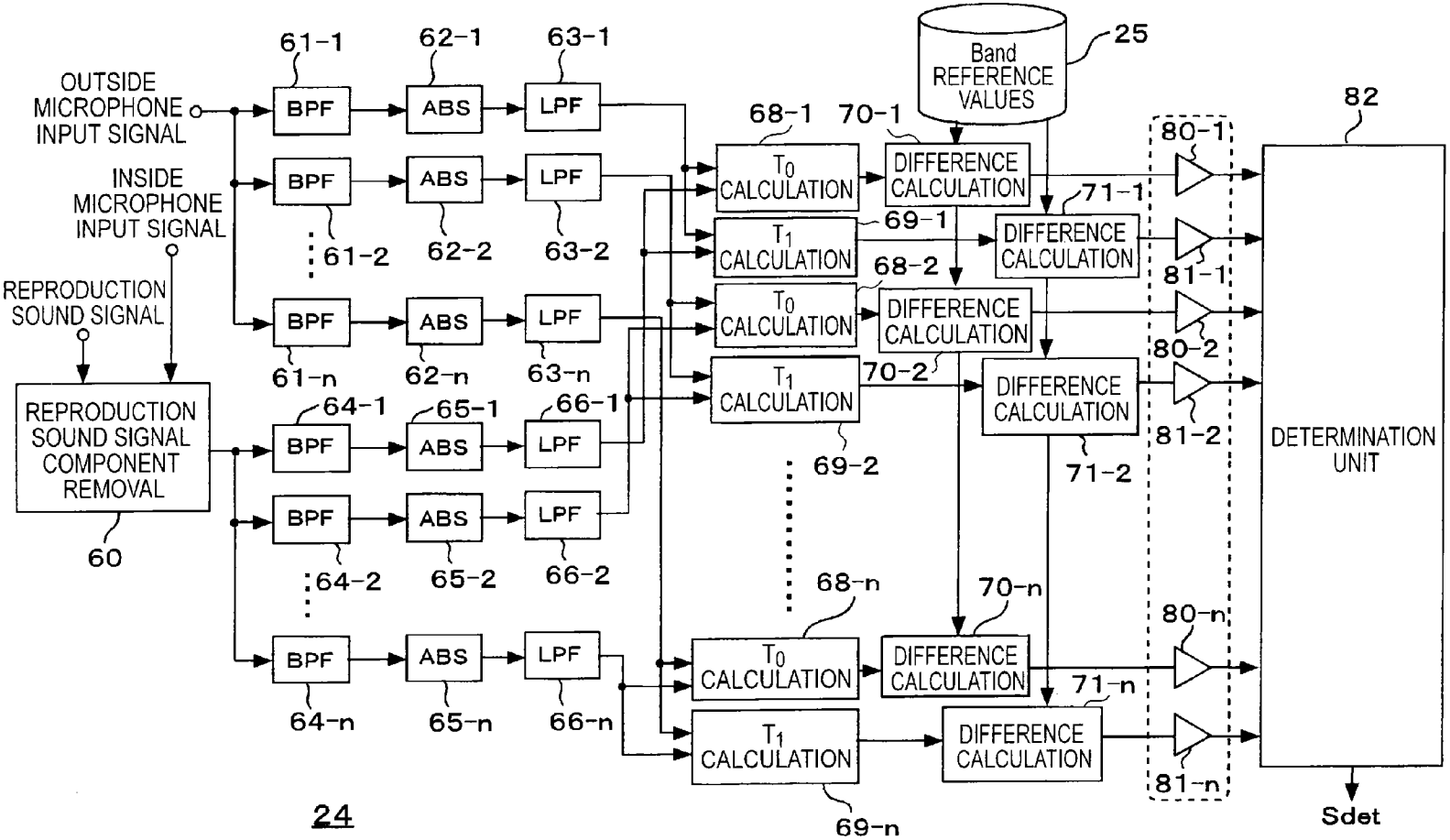
FIG. 23 is a block diagram of a wearing state detection unit of a fifth embodiment.

FIG. 23 illustrates a configuration example of the wearing state detection unit 24 as the fifth embodiment. For example, this may be considered to be an internal configuration of the wearing state detection unit 24 in the configuration examples of FIGS. 2, 12, 16, and 20.

An outside microphone input signal picked up by the outside microphone 4 and input to the wearing state detection unit 24 via the microphone amplifier 19 and the A/D converter 12 (see FIG. 2 and the like) is input to band pass filters (BPFs) 61-1 to **61-*n***.

Using the BPFs 61-1 to **61-*n***, the outside microphone input signal is extracted for every n frequency bands (first to $n^{th}$ bands).

In addition, an inside microphone input signal picked up by the inside microphone 5 and passing through the microphone amplifier 19 and the A/D converter 12 (see FIG. 2 and the like) and a reproduction sound signal via the A/D converter 11 (see FIG. 2 and the like) are input to a reproduction sound signal component removal unit 60 in the wearing state detection unit 24. The reproduction sound signal component removal unit 60 subtracts a reproduction sound signal from the inside microphone input signal, and obtains a sound pickup sound signal component of the inside microphone 5 from which a reproduction sound signal component has been removed. The sound pickup sound signal component of the inside microphone 5 from which the reproduction sound signal component has been removed is input to the BPFs 64-1 to **64-*n*, and the BPFs 64-1 to 64-*n*** extract the inside microphone input signal for every n frequency bands (first to $n^{th}$ bands).

Absolute value conversion units (ABS units) 62-1 to **62-*n* convert band signals for the outside microphone input signals output from the BPFs 61-1 to 61-*n* into absolute values. Low pass filters (LPFs) 63-1 to 63-*n*** remove high-frequency components to form envelopes.

In addition, signals of bands for the inside microphone input signal from which the reproduction sound signal component has been removed output from the BPFs 64-1 to **64-*n* are converted by absolute value conversion units (ABS units) 65-1 to 65-*n* into absolute values. LPFs 66-1 to 66-*n*** remove high-frequency components to form envelopes.

$T_0$ calculation units 68-1 to **68-*n* and $T_1$ calculation units 69-1 to 69-*n* are prepared. The $T_0$ calculation units 68-1 to 68-*n* perform the calculation of the calculated value $T_0$ shown in the above-described Equation (8) or the like. The $T_1$ calculation units 69-1 to 69-*n*** perform the calculation of the calculated value $T_1$ shown in the above-described Equation (9) or the like.

An output of the LPF 63-1 and an output of the LPF 66-1 are supplied to the $T_0$ calculation unit 68-1 and the $T_1$ calculation unit 69-1 as an outside microphone input signal (corresponding to the above-described "R") and an inside microphone input signal (corresponding to the above-described "P") of a first band. The $T_0$ calculation unit 68-1 obtains "$T_0$" of the first band and the $T_1$ calculation unit 69-1 obtains "$T_1$" of the first band.

Likewise, an output of the LPF 63-2 and an output of the LPF 66-2 are supplied to the $T_0$ calculation unit 68-2 and the $T_1$ calculation unit 69-2 as an outside microphone input signal and an inside microphone input signal of a second band. The $T_0$ calculation unit 68-2 obtains "$T_0$" of the second band and the $T_1$ calculation unit 69-2 obtains "$T_1$" of the second band.

Likewise, an output of the LPF **63-*n* and an output of the LPF 66-*n* are supplied to the $T_0$ calculation unit 68-*n* and the $T_1$ calculation unit 69-*n* as an outside microphone input signal and an inside microphone input signal of an $n^{th}$ band. The $T_0$ calculation unit 68-*n* obtains "$T_0$" of the $n^{th}$ band and the $T_1$ calculation unit 69-*n*** obtains "$T_1$" of the $n^{th}$ band.

In the memory 25, a non-wearing state reference value ($Q_0/R=1$) and a wearing state reference value ($Q_1/R=F_1/F_0$) are stored in each of the bands.

For example, pre-measurements described with reference to FIGS. 6A and 6B are performed in a state in which white noise or the like has been output from the sound source 110 via BPFs of the same pass bands as in the BPFs 61-1 to **61-*n*. Accordingly, in each of the first to $n^{th}$ bands, the non-wearing state reference value and the wearing state reference value (in this case, for example, amplitude values) are stored in the memory 25**.

In difference calculation units 70-1 to **70-*n*, differences between outputs $T_0$ of the $T_0$ calculation units 68-1 to 68-*n*** and non-wearing state reference values of bands corresponding thereto are calculated.

In difference calculation units 71-1 to **71-*n*, differences between outputs $T_1$ of the $T_1$ calculation units 69-1 to 69-*n*** and wearing state reference values of bands corresponding thereto are calculated.

Outputs of the difference calculation units 70-1 to **70-*n* are supplied to a determination unit 82 via coefficient units 80-1 to 80-*n*. Outputs of the difference calculation units 71-1 to 71-*n* are supplied to the determination unit 82 via coefficient units 81-1 to 81-*n***.

If coefficients (=1) of the coefficient units 80-1 to **80-*n* and 81-1 to 81-*n* are set, a difference (corresponding to $d_0$ of Equation (10) or the like) between the calculated value $T_0$ and the non-wearing state reference value and a difference (corresponding to $d_1$ of Equation (11) or the like) between the calculated value $T_1$ and the wearing state reference value are supplied to the determination unit 82** for each of the first to $n^{th}$ bands.

The determination unit 82 makes a determination of wearing/non-wearing from the above-described inputs.

Figure 24:
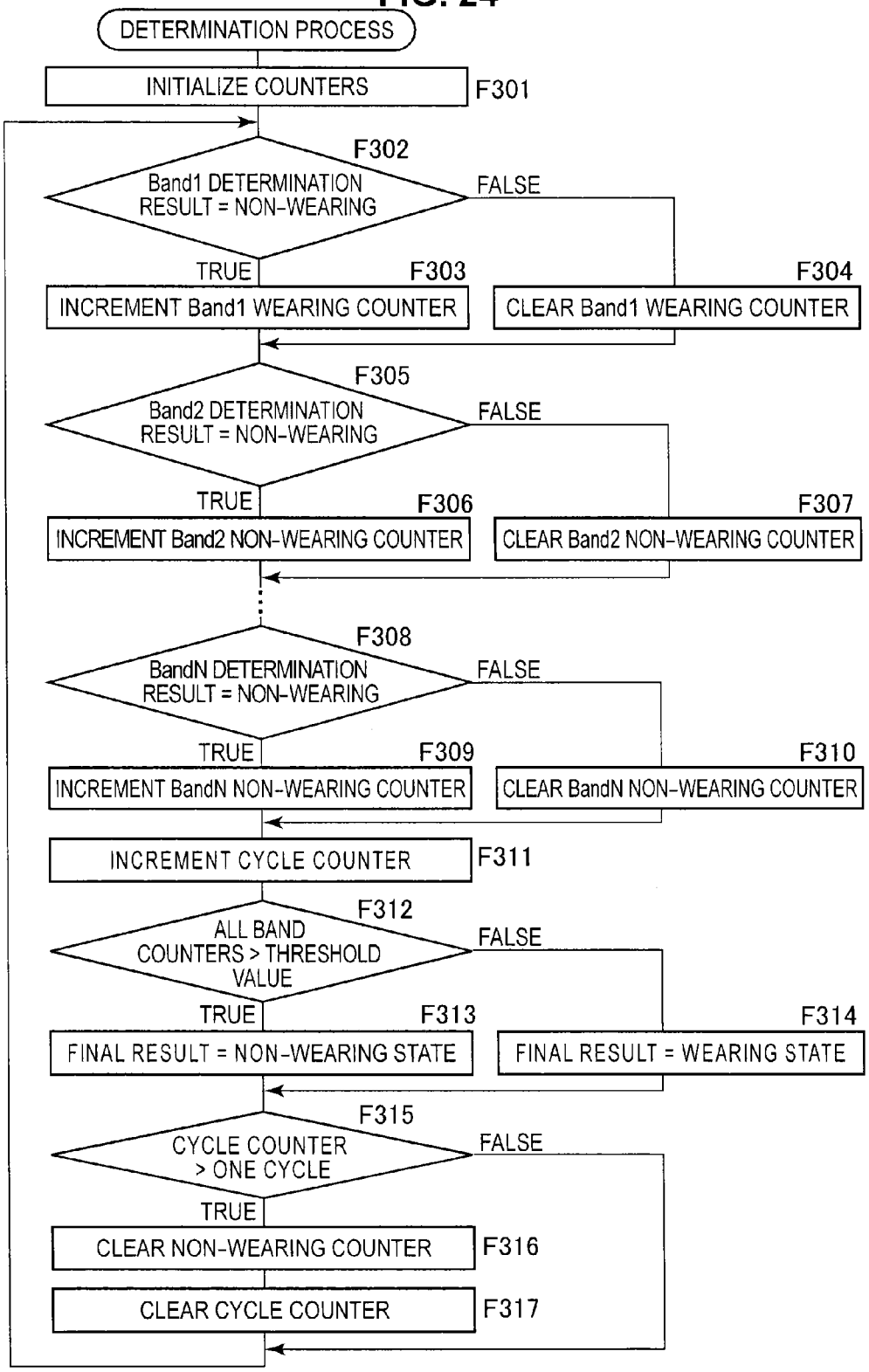
FIG. 24 is a flowchart of a wearing determination process of the fifth embodiment.

The determination unit 82, for example, can make the wearing determination in the process of FIG. 24.

That is, the number of determinations of non-wearing is counted in each frequency band. The state is determined to be non-wearing when all frequency bands have been continued a prescribed number of times. Alternatively, the state is determined to be non-wearing when all the frequency bands have reached a prescribed ratio or more.

The determination unit 82 initializes counters in step F301. For example, a cycle counter and a non-wearing counter are initialized. The cycle counter is a counter that counts one cycle serving as a given detection unit period, and the non-wearing counter is a counter that counts a continuation time of a state in which the state is detected to be the non-wearing state. In this case, non-wearing counters for first to $n^{th}$ bands are used as the non-wearing counter.

The determination unit 82 makes a determination of wearing/non-wearing of the first band in step F302. That is, wearing/non-wearing is determined by comparing the difference $d_0$ between the calculated value $T_0$ and the non-wearing state reference value to the difference $d_1$ between the calculated value $T_1$ and the wearing state reference value in the first band.

Accordingly, when the state is determined to be the non-wearing state, the non-wearing counter for the first band is incremented in step F303. On the other hand, when the state is determined to be the wearing state, the non-wearing counter for the first band is cleared in step F304.

In addition, the determination unit 82 makes a determination of wearing/non-wearing of the second band in step F305. That is, wearing/non-wearing is determined by comparing the difference $d_0$ between the calculated value $T_0$ and the non-wearing state reference value to the difference $d_1$ between the calculated value $T_1$ and the wearing state reference value in the second band.

Accordingly, when the state is determined to be the non-wearing state, the non-wearing counter for the second band is incremented in step F306. On the other hand, when the state is determined to be the wearing state, the non-wearing counter for the second band is cleared in step F307.

The above-described process is performed until the $n^{th}$ band (steps F308, F309, and F310).

When the above process has been performed for each band, the determination unit 82 increments the cycle counter in step F311.

Accordingly, the determination unit 82 checks whether all values of the non-wearing counters for the first to $n^{th}$ bands exceed a predetermined threshold value in step F312.

If all the values of the non-wearing counters for the first to $n^{th}$ bands exceed the predetermined threshold value, "non-wearing" is set as the final result in step F313 and the control unit 15 is notified of the non-wearing state according to the detection signal Sdet.

On the other hand, if the above is not satisfied, "wearing" is set as the final result in step F314 and the control unit 15 is notified of the wearing state according to the detection signal Sdet.

The determination unit 82 checks whether a value of the cycle counter has exceeded a counter value serving as one cycle determined in advance in step F315. When the value has not exceeded the counter value serving as the one cycle, the process from step F302 is directly continued. When the value has reached the one cycle, the determination unit 82 clears the non-wearing counters for the first to $n^{th}$ bands. Further, the determination unit 82 returns to step F302 by clearing the cycle counter in step F316.

The wearing state detection unit 24, for example, continuously executes the above process while the power supply is turned on. Thereby, when the determinations of the non-wearing determination states of all bands have been continued for a predetermined time or more in cycle units measured by the cycle counter, the control unit 15 is notified of the detection result serving as "non-wearing."

In the case of the fifth embodiment, the basic concept of the determination of wearing/non-wearing is similar to those of the first to fourth embodiment. However, in a specific comparison technique for the determination, a comparison result of "P" and "R" for every band is set to be compared to the non-wearing state reference value and the wearing state reference value in time series.

When the determination is made by dividing the band as described above, it is possible to weight a specific band according to coefficient settings of the coefficient units 80-1 to **80-*n* and 81-1 to 81-*n***.

For example, it is possible to improve determination precision by assigning a weight to a dominant band in which an amplitude difference occurs between sound pickup signals of the inside microphone 5 and the outside microphone 4.

Alternatively, because the dominant band is changed according to a noise environment, coefficient setting of each band may be performed according to an environment (for example, on a train, on an airplane, outdoors, or the like) and an accurate wearing state determination may be made according to the environment.

Further, a dominant band in which a difference is large while the determination process is continuous may be determined, and weighting may be performed so that a coefficient of the band is high.

In addition, although band divisions are the first to $n^{th}$ bands in the description of FIG. 23, n is greater than or equal to 1. For example, the determination process may be performed by extracting a dominant band in one BPF and a large number of bands such as three band, four bands, or five bands may be used.

In addition, it is not necessary to cover all audible bands in n bands of the first to $n^{th}$ bands.

In relation to the process of FIG. 24, a modified example as described with reference to FIG. 11 is also considered. That is, non-wearing counter clearing operations of step F304, F307, and F310 may not be performed, and the non-wearing counter may represent an accumulation time within one cycle instead of a continuation time.

In addition, in step F312, the final result is set as the non-wearing state in an AND condition indicating the case in which non-wearing counters in all the bands have exceeded the threshold value. However, an example in which the final result is set as the non-wearing state in another condition such as an OR condition or the case in which non-wearing counters of a predetermined number of bands have exceeded the threshold value is also considered.

Figure 25:
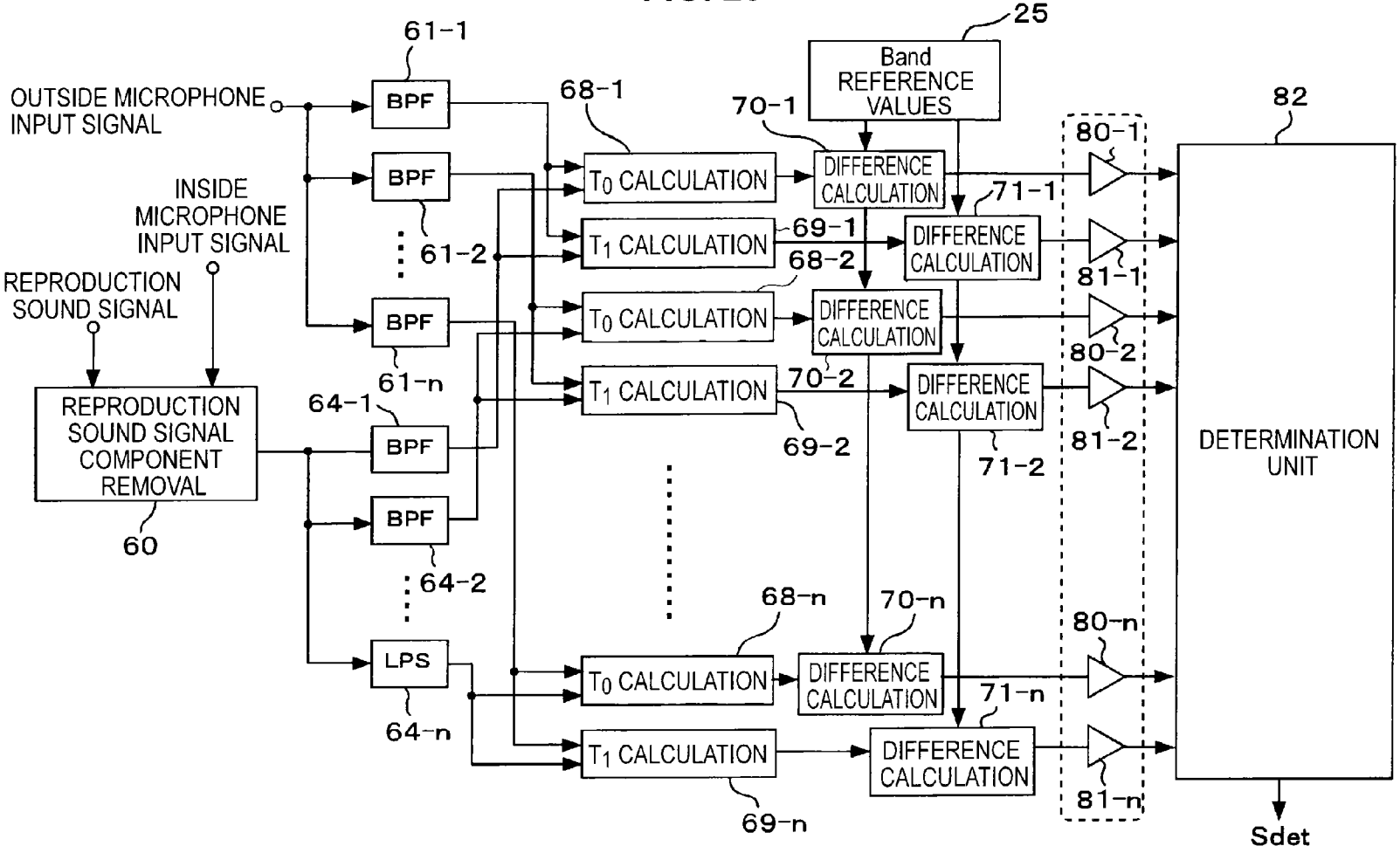
FIG. 25 is a block diagram of a wearing state detection unit of a modified example of the fifth embodiment.

In addition, a configuration as in FIG. 25 is also considered as the configuration of the wearing state detection unit 24. Also, the same parts as in FIG. 23 are assigned the same reference signs and description thereof is omitted.

In the configuration example of FIG. 25, absolute value conversion processes of the absolute value conversion units 62-1 to **62-*n* and 65-1 to 65-*n* and enveloping processes of the LPFs 63-1 to 63-*n* and 66-1 to 66-*n* in FIG. 23 are omitted. Other details are substantially the same as in FIG. 23**.

Wearing/non-wearing can be determined in the above-described configuration as well.

7. Modified Examples

Although various embodiments have been described above, various modified examples are further considered.

The technology of the present disclosure is also applicable to other types of headphone devices such as an inner ear type, a canal type, and the like as well as sealed headphones to be worn on a head as the headphones 1 of the embodiment. In addition, the technology of the present disclosure is also effective in a headphone device of one ear type.

In addition, the technology of the present disclosure is not limited to stereo headphones and can also operate in monaural headphones.

In addition, the technology of the present disclosure is suitable for headphones using batteries in a broad range such as headphones that are or are not equipped with a noise canceling system, headphones equipped with a wireless communication function such as Bluetooth, or headphones equipped with an active circuit for an acoustic process as the active headphones.

In addition, the inside microphone 5 or the outside microphone 4 can also be used as a microphone for communication. In this sense, the technology of the present disclosure is also suitable for headphones to be used through a connection to a portable phone device or the like.

Although the wearing state detection unit 24 and the control unit 15 are illustrated as separate bodies in FIGS. 2, 12, 16, and 20, a microcomputer or the like serving as the control unit 15 may execute an operation as the wearing state detection unit 24. That is, the control unit 15 and the wearing state detection unit 24 may be an integrated hardware configuration.

Although only one of the L channel and the R channel has been described in each embodiment, similar wearing detection may be independently or collectively performed in the two channels.

When the wearing detection operations are collectively performed, for example, it is only necessary to mix input sound signals of the outside microphones 4L and 4R and supply the mixed sound signals to the wearing state detection unit 24 and to mix input sound signals of the inside microphones 5L and 5R and supply the mixed sound signals to the wearing state detection unit 24.

Further, the wearing detection may be performed in only one channel.

Although the detection result of wearing/non-wearing of the L channel and the detection result of wearing/non-wearing of the R channel are obtained when the wearing state detection is independently performed in the L/R channels, various processing examples of the control unit 15 are considered.

For example, the power supply OFF control may be performed when the state is non-wearing in the AND condition of the L/R channels or the power supply OFF control may be performed when non-wearing is detected in one channel as the OR condition. The AND condition is preferred if importance is put on an operation in which the power supply is recklessly left on, and the OR condition is preferred if OFF of the power supply is desired as much as possible.

In addition, the control of the control unit 15 corresponding to the wearing/non-wearing detection result is not limited to power supply OFF control.

For example, a control operation of decreasing a sound volume of a reproduction sound when the state is determined to be non-wearing and generating an acoustic output from the driver unit 3 of the channel of the wearing state by performing monaural mixing on reproduction sounds of the L/R channels when the state is determined to be non-wearing only in one channel is also considered.

In addition, the power supply ON control may be performed. For example, even when the power supply is turned off (standby state), the wearing detection operation is set to be executed by the wearing state detection unit. Accordingly, when the wearing state is detected, the control unit 15 performs power supply ON control and starts up from a sleep state. Then, it is possible to implement active headphones in which the power supply can be turned on when the user wears the headphones, and turned off when the user takes the headphones off.

In addition, an optimum value of the wearing state reference value ($F_1/F_0$) for use in the wearing state detection as described in the embodiment differs according to an individual user. This is because a sealed situation of the housing 2 differs according to a shape of a head or the periphery of an auricle of the user, a hair amount of a wearing part, a wearing habit, and the like. A process of storing the wearing state reference value suitable for the user who actually uses the headphones by measuring the wearing state reference value in a state in which the user is wearing the headphones or calibrating the wearing state reference value is also considered.

In addition, although an example of the amplitude comparison on the frequency axis or the amplitude comparison on the time axis when the similarity determination is made by comparing the signal comparison result between the sound signal obtained by the outside microphone 4 and the sound signal obtained by the inside microphone 5 to the non-wearing state reference value and the wearing state reference value has been described, for example, a comparison process of detecting a signal phase difference of each frequency band is also considered.

It should be understood by those skilled in the art that various modifications, combinations, sub-combinations and alterations may occur depending on design requirements and other factors insofar as they are within the scope of the appended claims or the equals thereof.

Additionally, the present technology may also be configured as below.

(1) A headphone device including:

an outside microphone attached to a position at which an extraneous sound is picked up without passing through a shield in a state in which a user is wearing the headphone device;

an inside microphone attached to a position at which the extraneous sound is picked up via the shield in the state in which the user is wearing the headphone device;

a driver unit configured to perform an acoustic output; and a wearing state detection unit configured to detect a wearing state or a non-wearing state using a signal comparison result between a sound signal obtained by the outside microphone and a sound signal obtained by the inside microphone, a pre-stored non-wearing state reference value which is a signal comparison result between a sound signal obtained by the outside microphone and a sound signal obtained by the inside microphone when the extraneous sound arrives in the non-wearing state, and a pre-stored wearing state reference value which is a signal comparison result between a sound signal obtained by the outside microphone and a sound signal obtained by the inside microphone when the extraneous sound arrives in the wearing state.

(2) The headphone device according to (1), wherein the wearing state detection unit detects the wearing state or the non-wearing state by making similarity determination with each of the non-wearing state reference value and the wearing state reference value for the signal comparison result between the sound signal obtained by the outside microphone and the sound signal obtained by the inside microphone.

(3) The headphone device according to (2), wherein the wearing state detection unit performs, as the similarity determination, a process of comparing frequency characteristics serving as the signal comparison result between the sound signal obtained by the outside microphone and the sound signal obtained by the inside microphone to frequency characteristics serving as the non-wearing state reference value and the wearing state reference value.

(4) The headphone device according to (2), wherein the wearing state detection unit performs, as the similarity determination, a process of comparing a time axis amplitude serving as the signal comparison result between the sound signal obtained by the outside microphone and the sound signal obtained by the inside microphone to time axis amplitudes serving as the non-wearing state reference value and the wearing state reference value.

(5) The headphone device according to any one of (2) to (4), wherein the wearing state detection unit outputs a detection result with the non-wearing state for every given cycle when a continuation period or an accumulation time in which a result of the similarity determination is determined to be the non-wearing state has exceeded a threshold value.

(6) The headphone device according to any one of (1) to (5), further including:

a noise cancellation processing unit configured to generate a noise canceling signal from a picked-up extraneous sound signal and set the noise canceling signal as a sound signal output from the driver unit, wherein the extraneous sound signal to be supplied to the noise cancellation processing unit is configured to be obtained by one or both of the outside microphone and the inside microphone.

(7) The headphone device according to any one of (1) to (6), further including:

a sound signal processing unit configured to process a sound signal input from an external device as a sound signal output from the driver unit.

(8) The headphone device according to any one of (1) to (7), further including:

a control unit configured to perform power supply OFF control when the non-wearing state has been detected by the wearing state detection unit.

The present disclosure contains subject matter related to that disclosed in Japanese Priority Patent Application JP 2012-171975 filed in the Japan Patent Office on Aug. 2, 2012, the entire content of which is hereby incorporated by reference.

What is claimed is:

1. A headphone device comprising:

an outside microphone attached to a position at which an extraneous sound is picked up without passing through a shield in a state in which a user is wearing the headphone device;

an inside microphone attached to a position at which the extraneous sound is picked up via the shield in the state in which the user is wearing the headphone device;

a driver unit configured to perform an acoustic output; and a wearing state detection unit configured to detect a wearing state or a non-wearing state using a signal comparison result between a sound signal obtained by the outside microphone and a sound signal obtained by the inside microphone, a pre-stored non-wearing state reference value which is a signal comparison result between a sound signal obtained by the outside microphone and a sound signal obtained by the inside microphone when the extraneous sound arrives in the non-wearing state, and a pre-stored wearing state reference value which is a signal comparison result between a sound signal obtained by the outside microphone and a sound signal obtained by the inside microphone when the extraneous sound arrives in the wearing state.

2. The headphone device according to claim 1, wherein the wearing state detection unit detects the wearing state or the non-wearing state by making similarity determination with each of the non-wearing state reference value and the wearing state reference value for the signal comparison result between the sound signal obtained by the outside microphone and the sound signal obtained by the inside microphone.

3. The headphone device according to claim 2, wherein the wearing state detection unit performs, as the similarity determination, a process of comparing frequency characteristics serving as the signal comparison result between the sound signal obtained by the outside microphone and the sound signal obtained by the inside microphone to frequency characteristics serving as the non-wearing state reference value and the wearing state reference value.

4. The headphone device according to claim 2, wherein the wearing state detection unit performs, as the similarity determination, a process of comparing a time axis amplitude serving as the signal comparison result between the sound signal obtained by the outside microphone and the sound signal obtained by the inside microphone to time axis amplitudes serving as the non-wearing state reference value and the wearing state reference value.

5. The headphone device according to claim 2, wherein the wearing state detection unit outputs a detection result with the non-wearing state for every given cycle when a continuation period or an accumulation time in which a result of the similarity determination is determined to be the non-wearing state has exceeded a threshold value.

6. The headphone device according to claim 1, further comprising:

a noise cancellation processing unit configured to generate a noise canceling signal from a picked-up extraneous sound signal and set the noise canceling signal as a sound signal output from the driver unit, wherein the extraneous sound signal to be supplied to the noise cancellation processing unit is configured to be obtained by one or both of the outside microphone and the inside microphone.

7. The headphone device according to claim 1, further comprising:

a sound signal processing unit configured to process a sound signal input from an external device as a sound signal output from the driver unit.

8. The headphone device according to claim 1, further comprising:

a control unit configured to perform power supply OFF control when the non-wearing state has been detected by the wearing state detection unit.

9. A wearing state detection method of a headphone device including an outside microphone attached to a position at which an extraneous sound is picked up without passing through a shield in a state in which a user is wearing the headphone device, an inside microphone attached to a position at which the extraneous sound is picked up via the shield in the state in which the user is wearing the headphone device, and a driver unit configured to perform an acoustic output, the wearing state detection method comprising:

detecting a wearing state or a non-wearing state using a signal comparison result between a sound signal obtained by the outside microphone and a sound signal obtained by the inside microphone, a pre-stored non-wearing state reference value which is a signal comparison result between a sound signal obtained by the outside microphone and a sound signal obtained by the inside microphone when the extraneous sound arrives in the non-wearing state, and a pre-stored wearing state reference value which is a signal comparison result between a sound signal obtained by the outside microphone and a sound signal obtained by the inside microphone when the extraneous sound arrives in the wearing state.

10. A headphone device comprising:

an outside microphone attached to a position at which an extraneous sound is picked up without passing through a shield in a state in which a user is wearing the headphone device;

an inside microphone attached to a position at which the extraneous sound is picked up via the shield in the state in which the user is wearing the headphone device;

an acoustic driver; and circuitry configured to detect a wearing state or a non-wearing state using a signal comparison result between a sound signal obtained by the outside microphone and a sound signal obtained by the inside microphone, a pre-stored non-wearing state reference value which is a signal comparison result between a sound signal obtained by the outside microphone and a sound signal obtained by the inside microphone when the extraneous sound arrives in the non-wearing state, and a pre-stored wearing state reference value which is a signal comparison result between a sound signal obtained by the outside microphone and a sound signal obtained by the inside microphone when the extraneous sound arrives in the wearing state.

11. The headphone device according to claim 10, wherein the circuitry is configured to detect the wearing state or the non-wearing state by making similarity determination with each of the non-wearing state reference value and the wearing state reference value for the signal comparison result between the sound signal obtained by the outside microphone and the sound signal obtained by the inside microphone.

12. The headphone device according to claim 11, wherein the circuitry is configured to perform, as the similarity determination, a process of comparing frequency characteristics serving as the signal comparison result between the sound signal obtained by the outside microphone and the sound signal obtained by the inside microphone to frequency characteristics serving as the non-wearing state reference value and the wearing state reference value.

13. The headphone device according to claim 11, wherein the circuitry is configured to perform, as the similarity determination, a process of comparing a time axis amplitude serving as the signal comparison result between the sound signal obtained by the outside microphone and the sound signal obtained by the inside microphone to time axis amplitudes serving as the non-wearing state reference value and the wearing state reference value.

14. The headphone device according to claim 11, wherein the circuitry is configured to output a detection result with the non-wearing state for every given cycle when a continuation period or an accumulation time in which a result of the similarity determination is determined to be the non-wearing state has exceeded a threshold value.

15. The headphone device according to claim 10, wherein the circuitry is configured to generate a noise canceling signal from a picked-up extraneous sound signal and set the noise canceling signal as a sound signal output from the acoustic driver, and the extraneous sound signal is obtained by one or both of the outside microphone and the inside microphone.

16. The headphone device according to claim 10, wherein the circuitry is configured to process a sound signal input from an external device as a sound signal output from the acoustic driver.

17. The headphone device according to claim 10, wherein the circuitry is configured to perform power supply OFF control when the non-wearing state has been detected.

* * * * *